US009048046B2

(12) United States Patent
Yamazaki et al.

(10) Patent No.: US 9,048,046 B2
(45) Date of Patent: Jun. 2, 2015

(54) OSCILLATION OPERATION INPUT DEVICE

(75) Inventors: Yasuhiko Yamazaki, Nagoya (JP); Shingo Kitabayashi, Gyoda (JP); Masaaki Hirao, Kazo (JP)

(73) Assignee: DENSO CORPORATION, Kariya (JP)

( * ) Notice: Subject to any disclaimer, the term of this patent is extended or adjusted under 35 U.S.C. 154(b) by 219 days.

(21) Appl. No.: 13/425,822

(22) Filed: Mar. 21, 2012

(65) Prior Publication Data

US 2012/0287033 A1 Nov. 15, 2012

(30) Foreign Application Priority Data

Mar. 24, 2011 (JP) ..... 2011-066011

(51) Int. Cl.
*H01H 25/04* (2006.01)
*G05G 9/047* (2006.01)

(52) U.S. Cl.
CPC ..... *H01H 25/04* (2013.01); *G05G 9/047* (2013.01)

(58) Field of Classification Search
None
See application file for complete search history.

(56) References Cited

U.S. PATENT DOCUMENTS

| | | | | |
|---|---|---|---|---|
| 4,237,629 | A * | 12/1980 | Schmidt | 37/234 |
| 5,889,242 | A | 3/1999 | Ishihara et al. | |
| 6,348,664 | B2 * | 2/2002 | Kozuma | 200/6 A |
| 6,713,692 | B2 * | 3/2004 | Yamasaki | 200/6 A |
| 6,884,948 | B2 | 4/2005 | Gotoh | |
| 6,979,785 | B2 * | 12/2005 | Yamasaki | 200/6 A |
| 7,227,090 | B2 | 6/2007 | Kakuno et al. | |
| 7,480,522 | B2 * | 1/2009 | Wong et al. | 455/575.1 |
| 2004/0069601 | A1 * | 4/2004 | Gotoh | 200/17 R |
| 2007/0077058 | A1 | 4/2007 | Kontani | |

FOREIGN PATENT DOCUMENTS

| | | |
|---|---|---|
| JP | S59-125034 | 8/1984 |
| JP | U-06-17073 | 3/1994 |
| JP | 08-212877 | 8/1996 |
| JP | 10-125180 | 5/1998 |
| JP | 2000-195383 | 7/2000 |
| JP | 2004-179047 | 6/2004 |
| JP | 2005-044582 | 2/2005 |

(Continued)

OTHER PUBLICATIONS

Office Action dated May 28, 2013 in corresponding Korean Application No. 10-2012-29957.

(Continued)

*Primary Examiner* — David D Davis
(74) *Attorney, Agent, or Firm* — Harness, Dickey & Pierce, PLC

(57) ABSTRACT

An operation input device includes: an operation body having a handle portion. The operation body tilting around a rotation center point when a user tilts the operation axis line of the handle portion. The operation body tilting in a predetermined number of tilting directions. The operation input device including multiple detection portions, the number of the detection portions being less than the predetermined number of tilting directions of the operation body. Each detection portion outputting a first output value when the operation body tilts in a direction corresponding to the detection portion and outputting a second output value when the operation body tilts in a direction not corresponding to the detection portion. A determination device determines a tilting direction of the operation body based on information on the number of first output values and information on a part of the detection portions that have outputted the first output values.

7 Claims, 28 Drawing Sheets

(56) References Cited

FOREIGN PATENT DOCUMENTS

| | | |
|---|---|---|
| JP | 2006-278084 | 10/2006 |
| JP | 2006-286334 | 10/2006 |
| JP | 2008-198413 | 8/2008 |
| JP | 2010-003424 | 1/2010 |
| JP | 2010-055914 | 3/2010 |
| KR | 10-2012-0039188 | 4/2012 |

OTHER PUBLICATIONS

Office Action dated May 29, 2013 in corresponding Korean Application No. 10-2012-29947.
Office Action dated May 27, 2013 in corresponding Korean Application No. 10-2012-29746.
Office Action issued Feb. 8, 2013 in corresponding Japanese Application No. 2011-066062 with English translation.
Office Action issued Feb. 8, 2013 in corresponding Japanese Application No. 2011-066011 with English translation.
Office Action issued Feb. 8, 2013 in corresponding Japanese Application No. 2011-065655 with English translation.
Office Action issued Feb. 8, 2013 in corresponding Japanese Application No. 2011-065622 with English translation.
Office Action in corresponding U.S. Appl. No. 13/425,733, filed Feb. 26, 2014.
Office Action in corresponding U.S. Appl. No. 13/425,721, filed Feb. 3, 2014.
Office Action in corresponding Chinese Application No. 201210080859.9 dated Jan. 23, 2014 with English translation.
Office Action in corresponding Chinese Application No. 201210080796.7 dated Jan. 23, 2014 with English translation.
Office Action dated Jul. 28, 2014 in corresponding Chinese Application No. 201210080859.9.
Office Action dated Sep. 18, 2014 in corresponding U.S. Appl. No. 13/425,733.
Office Action issued Apr. 17, 2014 in co-pending U.S. Appl. No. 13/425,721.
U.S. Appl. No. 13/425,721, filed Mar. 21, 2012, Yamazaki et al.
U.S. Appl. No. 13/425,685, filed Mar. 21, 2012, Yamazaki et al.
U.S. Appl. No. 13/425,733, filed Mar. 21, 2012, Yamazaki et al.
U.S. Appl. No. 13/425,697, filed Mar. 21, 2012, Yamazaki et al.
Search/Examination Report issued Aug. 4, 2014 in corresponding CN Application No. 201210080738.4 (with translation).
Search/Examination Report issued Aug. 8, 2014 in corresponding CN Application No. 201210080796.7 (with translation).

* cited by examiner

FIG. 28

| | | Photo interrupter 14a | Photo interrupter 14b | Photo interrupter 14c | Photo interrupter 14d |
|---|---|---|---|---|---|
| OSCIL-LATION | D1 | ON | OFF | OFF | OFF |
| | D2 | ON | ON | OFF | OFF |
| | D3 | OFF | ON | OFF | OFF |
| | D4 | OFF | ON | ON | OFF |
| | D5 | OFF | OFF | ON | OFF |
| | D6 | OFF | OFF | ON | ON |
| | D7 | OFF | OFF | OFF | ON |
| | D8 | ON | OFF | OFF | ON |
| SHAFT PUSHING | | ON | ON | ON | ON |

OSCILLATION OPERATION INPUT DEVICE

CROSS REFERENCE TO RELATED APPLICATION

This application is based on Japanese Patent Application No. 2011-66011 filed on Mar. 24, 2011, the disclosure of which is incorporated herein by reference.

TECHNICAL FIELD

The present disclosure relates to relates to an operation input device.

BACKGROUND

Operation input devices of many different configurations are used in various fields, and there is an operation input device configured to accept multiple operations, such as depressing and rotation, by a single device. One example is disclosed in Patent Document 1 specified below. This document discloses an other-direction operation switch that allegedly eliminates a need for visual confirmation during an operation and causes no erroneous operation.

Patent Document 1: JP-A-2007-128862

An operation input device of this type includes a device of a type configured to accept an oscillation (tilting) operation in multiple directions (for example, eight directions). In the operation input device of this type, there is a case where a detection device, such as switch, is provided in each oscillation direction to detect respective oscillation directions.

In this instance, the fabrication sequence can be simpler and the cost can be saved by reducing the detection devices as few as possible. In the operation input device in the related art, however, it is difficult to say that this circumstance is viewed as a problem. It goes without saying that a capability of detecting respective oscillation, directions in a reliable manner is required even when the number of detection means is reduced. Accordingly, there is a need for an operation input device that achieves such an object.

SUMMARY

It is an object of the present disclosure to provide an operation input device accepting an oscillation operation in predetermined multiple directions and capable of detecting an oscillation direction in a reliable manner while reducing detection devices of the oscillation directions as few as possible.

According to an aspect of the present disclosure, an operation input device includes: an operation body having a handle portion, the handle portion being configured to be held by a user and having a virtual operation axis line, the operation body being configured to tilt together with the handle portion around a predetermined rotation center point on the operation axis line in a case where the user holds the handle portion and tilts the operation axis line of the handle portion, and the operation body being capable of tilting in a predetermined number of tilting directions; a plurality of detection portions disposed at predetermined intervals in a circumferential direction of the operation axis line, the number of the plurality of detection portions being less than the predetermined number of tilting directions, each detection portion outputting a first output value in a case where the operation body tilts in a direction corresponding to the detection portion and outputting a second output value in a case where the operation body tilts in a direction not corresponding to the detection portion; and a determination device that determines a tilting direction of the operation body on the basis of information on the number of first output values outputted from a part of the plurality of the detection portions and information on the part of the detection portions that have outputted the first output values.

In the operation input device above, by effectively using information as to whether one or more than one detection portion are outputting an ON value, it becomes possible to detect a tilting direction in a reliable manner even when there are fewer detection portions than the predetermined number of tilting directions. It thus becomes possible to achieve an operation input device capable of detecting a tilting direction in a reliable manner while achieving an object to reduce the number of detection portions.

BRIEF DESCRIPTION OF THE DRAWINGS

The above and other objects, features and advantages of the present disclosure will become more apparent from the following detailed description made with reference to the accompanying drawings. In the drawings:

FIG. 28 is a view depicting a determination method of the tilting operation and the shaft pushing operation;

DETAILED DESCRIPTION

Figure 1:
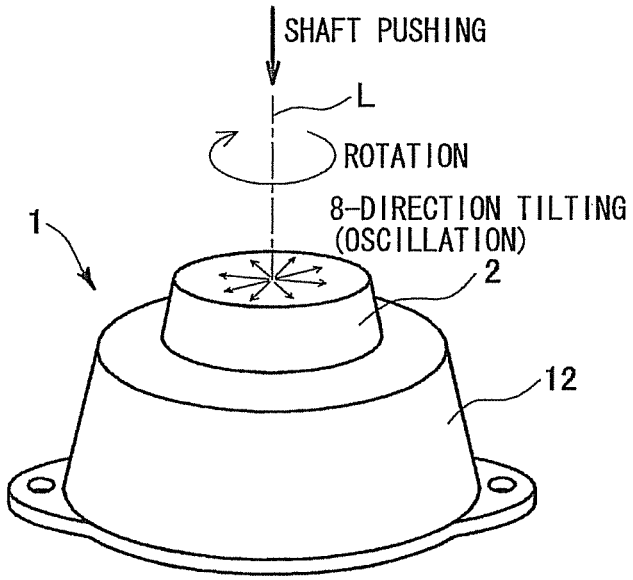
FIG. 1 is a perspective view of an operation input device according to one embodiment.
Figure 2A:
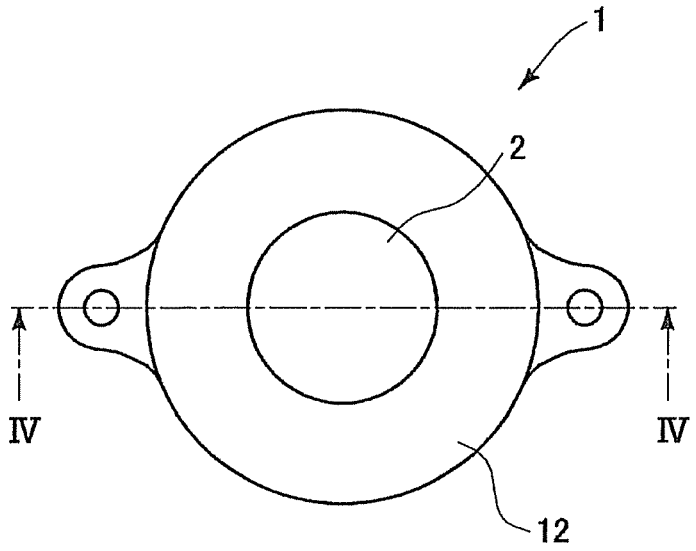
FIG. 2A is a plan view and FIG. 2B is a front view of the operation input device.
Figure 2B:
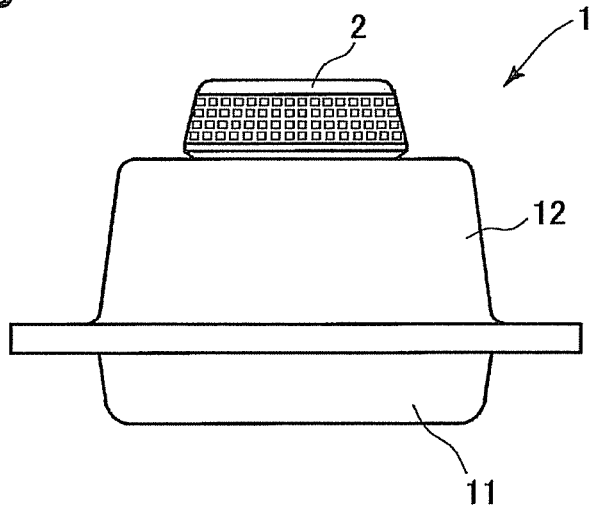
Figure 3:
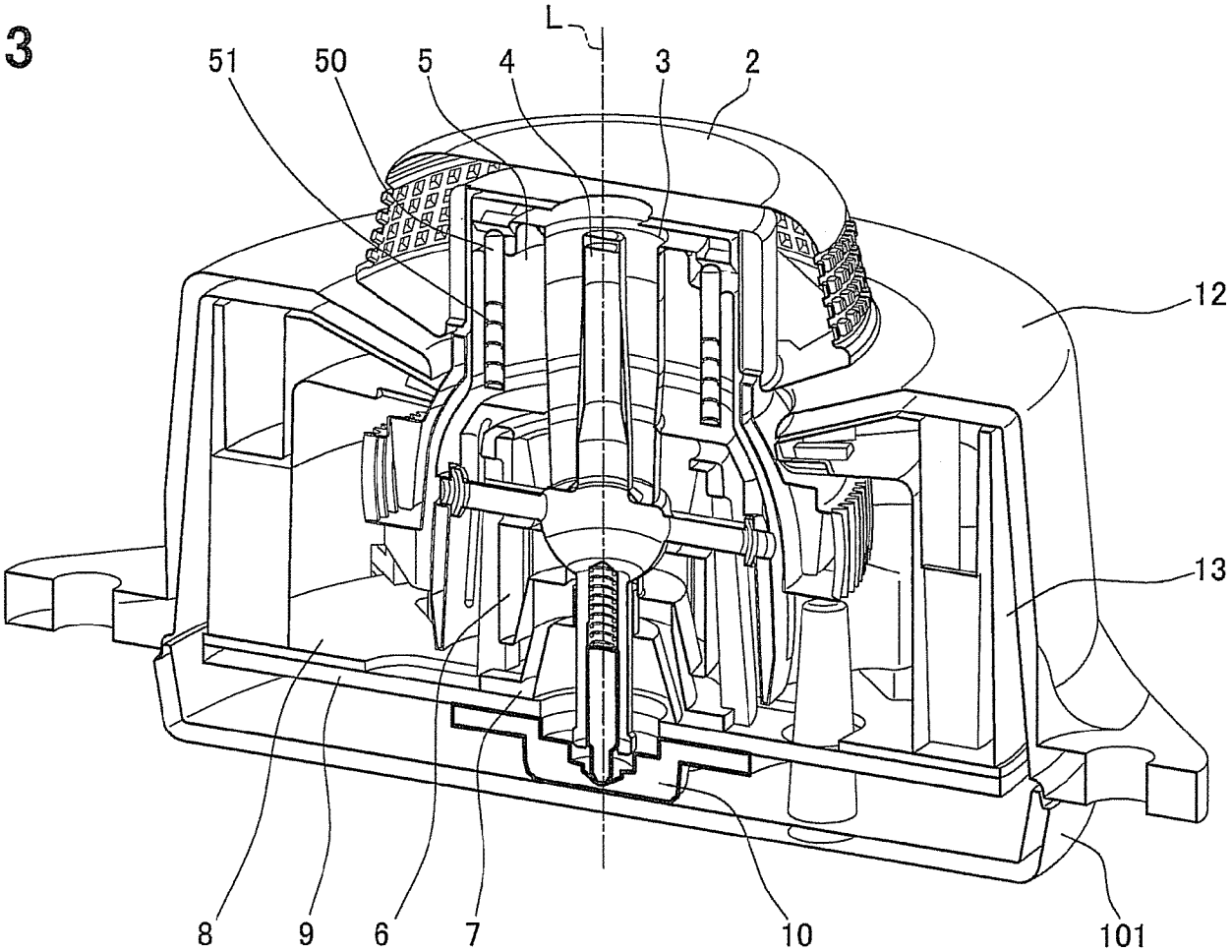
FIG. 3 is a perspective view of the operation input device with a cross section.
Figure 4:
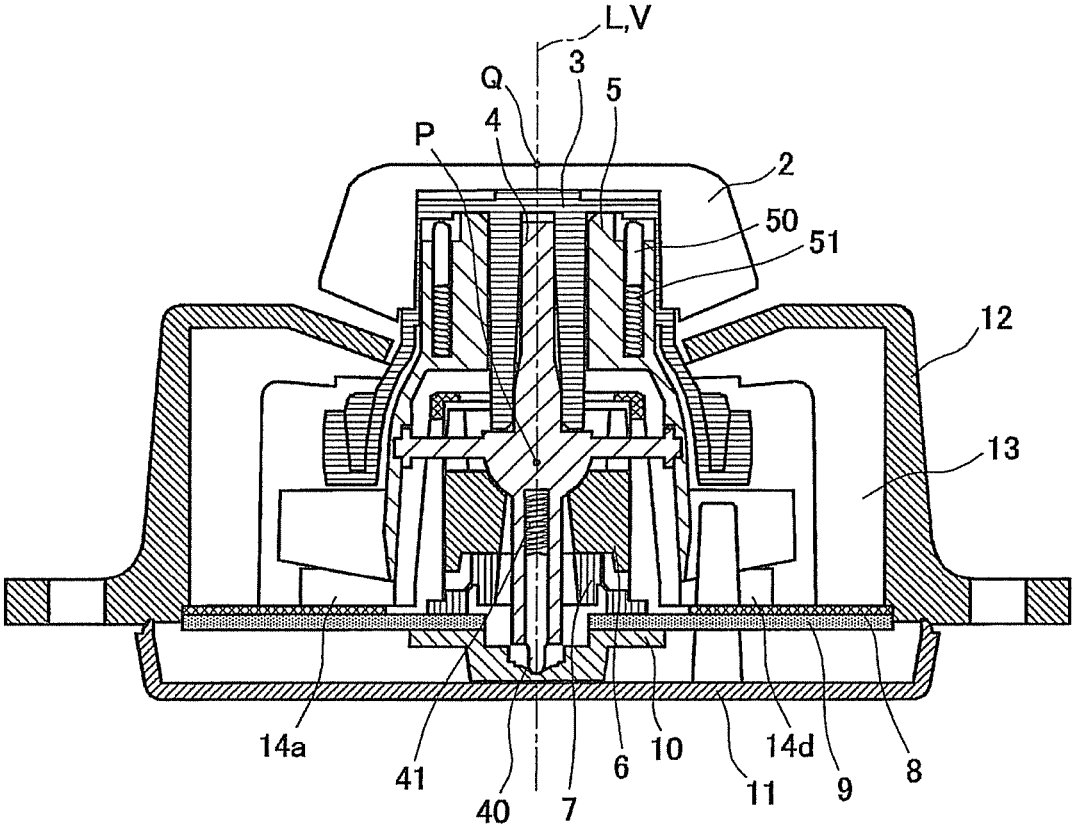
FIG. 4 is a cross section taken along the line IV-IV of the operation input device of FIG. 2A.

FIG. 1 is a perspective view of an operation input device 1 (hereinafter, referred to as the device) according to an embodiment of the present disclosure. FIG. 2A is a plan view and FIG. 2B is a side view of the device 1. FIG. 3 is a perspective view showing an interior made visible on a cross section taken along the line IV-IV. FIG. 4 is a cross section taken along the line IV-IV.

The device 1 includes a knob 2, a rotation shaft 3, a center shaft 4, a swing shaft 5, a slider 6, a press rubber 7, a holder 8, a substrate 9, a click plate 10, a cover 11, a case 12, an upper housing 13, an oscillation plunger 40, an oscillation spring 41, a rotation plunger 50, and a rotation plunger 51. FIG. 5A through FIG. 16B are views showing these components individually. In FIG. 5A through FIG. 16B, cross sections taken along the lines VB-VB through XVIB-XVIB are the same as the cross section taken along the line IV-IV shown in FIG. 4. With regard to materials of the device 1, for example, the press rubber 7 can be made of rubber (gum), the oscillation plunger 40 of brass, the oscillation spring 41 and the rotation spring 51 of stainless or a steel wire, and the rest of resin.

Hereinafter, the term, "horizontal", means a horizontal direction as shown in FIG. 4 unless specified otherwise. Also, the term, "vertical", means a direction perpendicular to the horizontal direction unless specified otherwise. Further, the terms, "upper" and "lower", referred to hereinafter mean an upward direction and a downward direction, respectively, of FIG. 4 unless specified otherwise.

As is shown in FIG. 1, the operation input device 1 is a device that enables a user holding the knob 2 to perform operation inputs including shaft pushing, rotation, and 8-direction tilting (oscillation) operations. Referring to FIG. 4, a virtual straight line passing through the knob 2 at a center in a left-right direction as shown in the drawing is given as an operation axis line L. Assume that the operation axis line L is a virtual line fixed to the knob and moves in association with motion of the knob 2.

Figure 17:
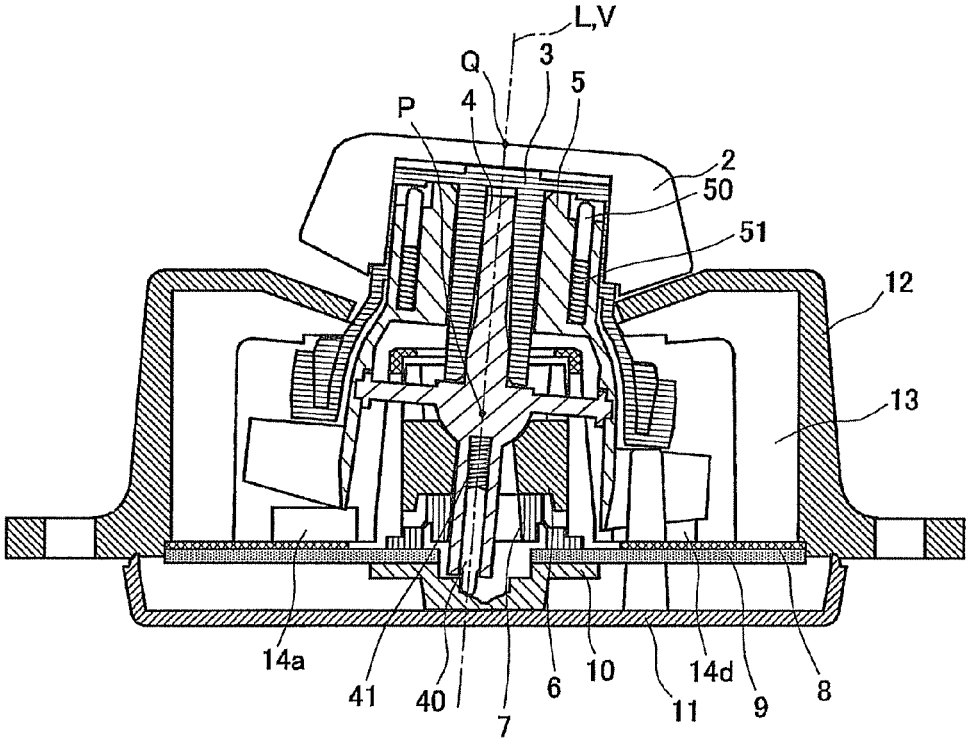
FIG. 17 is a view showing the operation input device during a tilting operation.

In a shaft pushing operation, the user presses the knob 2 downward in a direction parallel to the operation axis line L. In a rotation operation, the user turns the knob 2 about the operation axis line L as the center axis. In a tilting (oscillation) operation, the user tilts the knob 2 in eight directions. As is shown in FIG. 17 (described below), a virtual axis line in a direction perpendicular to a substrate surface of the substrate 9 is given as a vertical axis line V. Assume that the operation axis line L agrees with the vertical axis line V when a tilting operation is not performed on the knob 2. A tilting center point P is present on the vertical axis line V and the operation axis line L. The operation axis line L tilts with respect to the vertical axis line V about the tilting center point P as a tilting operation is performed on the knob 2. These operations will be described in detail below.

As are shown in FIG. 2A and FIG. 2B, the device 1 is of a shape in which the knob 2 protrudes upward as shown in the drawing from the case 12. A lower portion of the device 1 is covered with the cover 11. The device 1 is installed, for example, in an interior of an automobile and fixed to a place within arm's reach, of the driver by tightening screws inserted into hole portions (descried below) provided to the case 12 in such a manner that the cover 11 is not exposed to the interior side.

The knob 2, the rotation shaft 3, the center shaft 4, the swing shaft 5, the slider 6, the press rubber 7, the holder 8, the substrate 9, the click plate 10, the cover 11, the case 12, the upper housing 13, and the oscillation plunger 40 are, with a partial exception, basically of a circular shape in cross section perpendicular to a direction of the vertical axis line V.

Figure 5A:
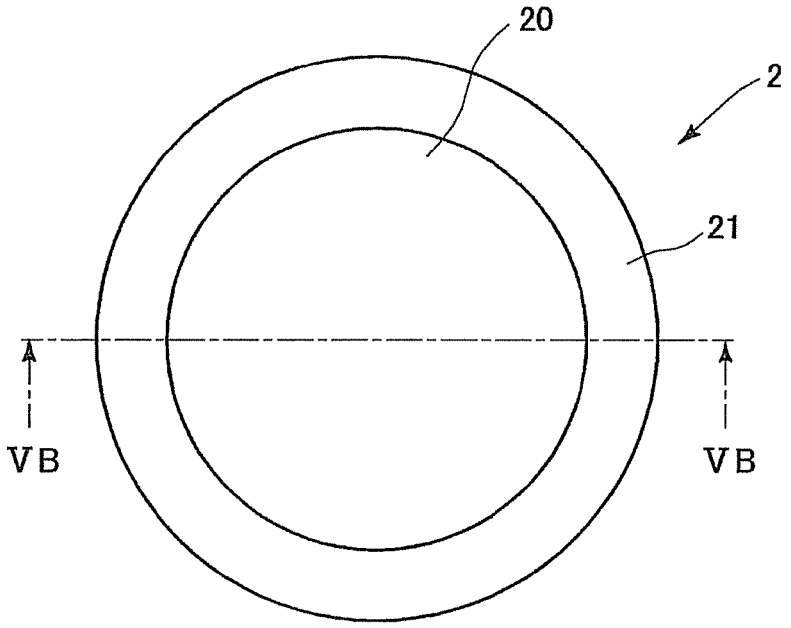
FIG. 5A is a plan view of a knob and FIG. 5B is a cross section taken along the line VB-VB of the knob of FIG. 5A.
Figure 5B:
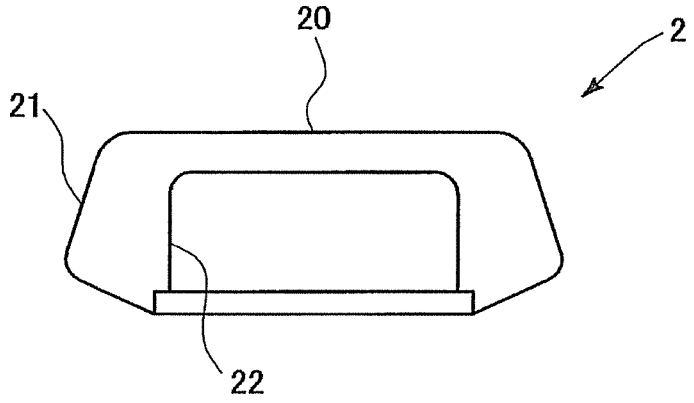

FIG. 5A and FIG. 5B are a plane view and a cross section taken along the line VB-VB, respectively, of the knob 2. The knob 2 is of a shape in which a tube portion 21 that encloses the rotation shaft 3 from above as shown in the drawing is provided to extend from a top surface 20 in an upper part as shown in the drawing. The knob 2 and the rotation shaft 3 are fixed to each other as the rotation shaft 3 is inserted into an inner surface 22 of the tube portion 21.

Figure 6A:
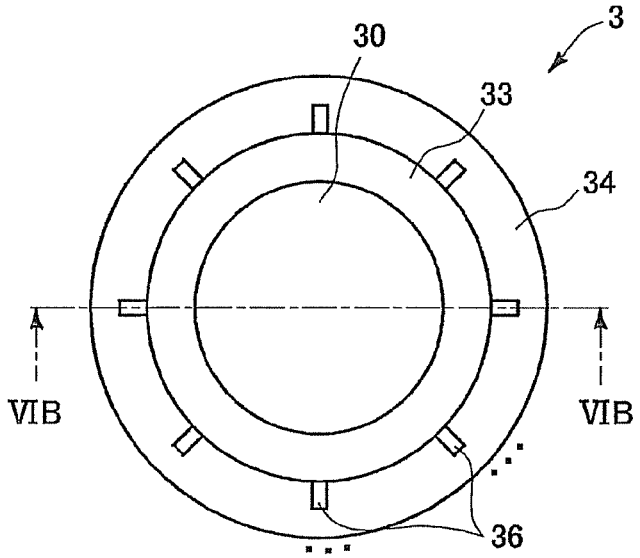
FIG. 6A is a plan view of a rotation shaft.
Figure 6B:
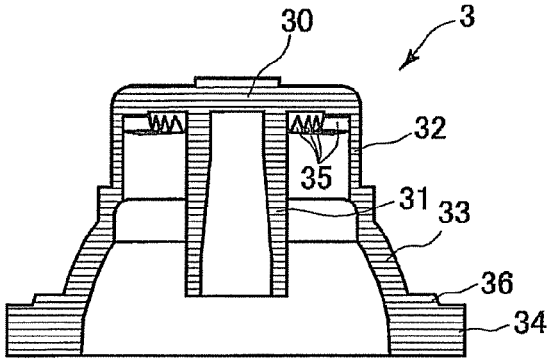
FIG. 6B is a cross section taken along the line VB-VB of the rotation shaft of FIG. 6A.
Figure 6C:
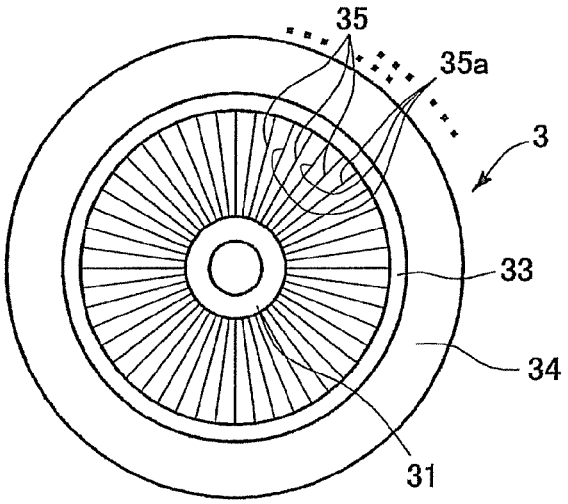
FIG. 6C is a bottom view of the rotation shaft.

FIG. 6A through FIG. 6C are a plan view, a cross section taken along the line VIB-VIB, and a bottom view, respectively, of the rotation shaft 3. The rotation shaft 3 includes two cylinder portions 31 and 32 provided to extend downward as shown in the drawing from a circular plate portion 30 of a disc shape. The inner cylinder portion 31 encloses the center shaft 4 from above as shown in the drawing and from radially outward. The inner cylinder portion 31 is enclosed by the swing shaft 5 from radially outward. The outer cylinder portion 32 encloses the swing shaft 5 from above as shown in the drawing and from radially outward. Hence, the swing shaft 5 is pinched by the inner cylinder portion 31 and the outer cylinder portion 32 from radially inward and outward, respectively.

The outer cylinder portion 32 of the rotation shaft 3 has a ball-like portion 33 of a spherical shape about the tilting center point P in a portion on a lower side as shown in the drawing. Upward motion of the rotation shaft 3 is stopped as the surface of the ball-like portion 33 abuts on the upper housing 13. A flange portion 34 is provided to extend radially outward from the ball-like portion 33 at a lower end as shown in the drawing.

In a region between the inner cylinder portion 31 and the outer cylinder portion 32 of the circular plate portion 30 on a surface on a lower side as shown in the drawing, a plurality of convex portions 35 protruding downward as shown in the drawing are formed all along a circumferential direction. As are shown in FIG. 6B and FIG. 6C, the convex portions 35 are formed in such a manner that angle protrusions each having a radially extending ridge are aligned regularly along the circumferential direction. Accordingly, a turning operation of the knob 2 is a turning operation by a predetermined turning angle at a time (described below).

A plurality of ribs 36 (convex portions) protruding upward as shown in the drawing are formed at regular intervals along the circumferential direction in a radially inner portion on the top surface of the flange portion 34. More specifically, the ribs 36 of a trapezoidal shape (rectangular shape) in cross section (cross section orthogonal to the radial direction) are formed on the top surface of the flange 34 so as to extend radially outward.

Figure 7A:
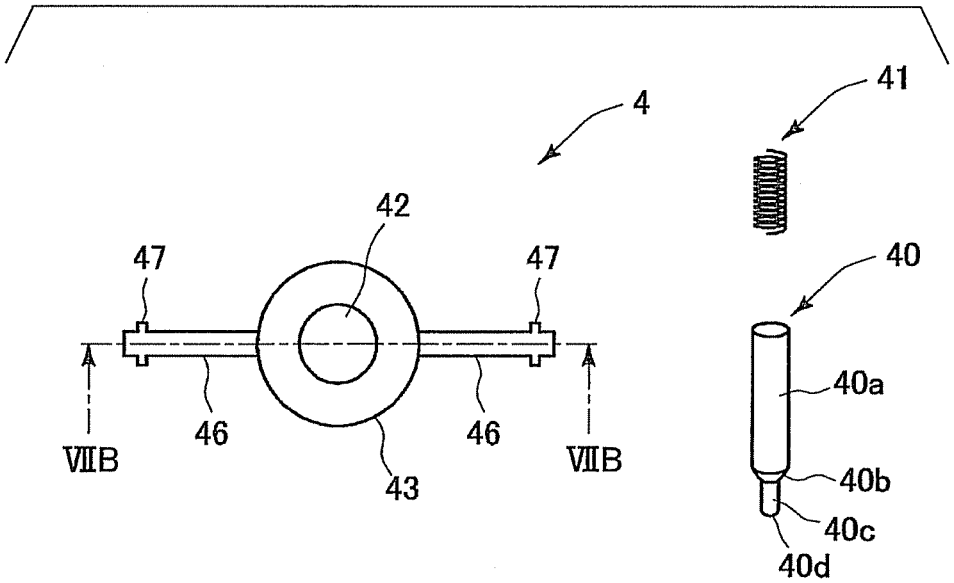
FIG. 7A is a plan view of a center shaft and FIG. 7B is a cross section taken along the line VIIB-VIIB of the center shaft of FIG. 7A.
Figure 7B:
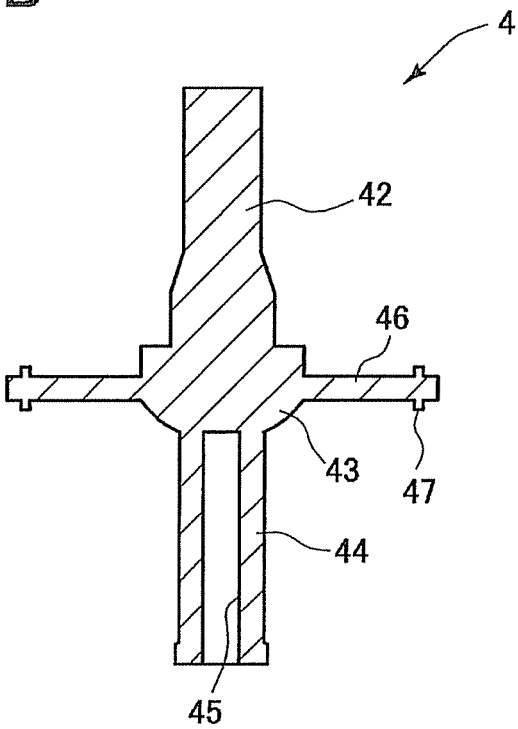

FIG. 7A and FIG. 7B show a plan view and a cross section taken along the line VIIB-VIIB, respectively, of the center shaft 4. The center shaft 4 includes a ball-like portion 43 of a semi-spherical shape on a lower side of a shaft portion 42 and further a tube portion 44 on a lower side of the ball-like portion 43. Bar portions 46 of a bar shape are provided to the ball-like portion 43 in the left-right direction as shown in the drawing. Protrusion portions 47 are formed in the vicinity of the tip ends of the respective bar portions 46.

The shaft portion 42 is inserted into the inner cylinder portion 31 of the rotation shaft 3. The ball-like portion 43 is supported by the slider 6 from below. The tip end of each bar portion 46 and the protrusion portion 47 are inserted into a hole portion 58 (described below) provided to the swing shaft 5 by passing through a through-hole portion 82 (described below) of the holder 8 and fixed therein.

The oscillation plunger 40 and the oscillation spring 41 are inserted into an inner surface 45 of the tube portion 44. The oscillation plunger 40 is pushed downward by an elastic restoring force of the oscillation spring 41. The oscillation plunger 40 is pressed against a concave surface (described below) formed in the click plate 10.

The oscillation plunger 40 includes a large diameter portion 40*a* of a cylindrical pillar shape having a large diameter and a small diameter portion 40*c* of a cylindrical pillar shape having a small diameter that are connected to each other with a taper portion 40*b*. A tip end of the small diameter portion 40*c* forms a tip end surface 40*d* of a curved surface shape. The oscillation plunger 40 together with the oscillation spring 41 is inserted into the tube portion 44 of the center shaft 4. The oscillation plunger 40 is pushed by elasticity of the oscillation spring 41 and the tip end surface 40*d* abuts on a concave surface 103 of the click plate 10.

Figure 8A:
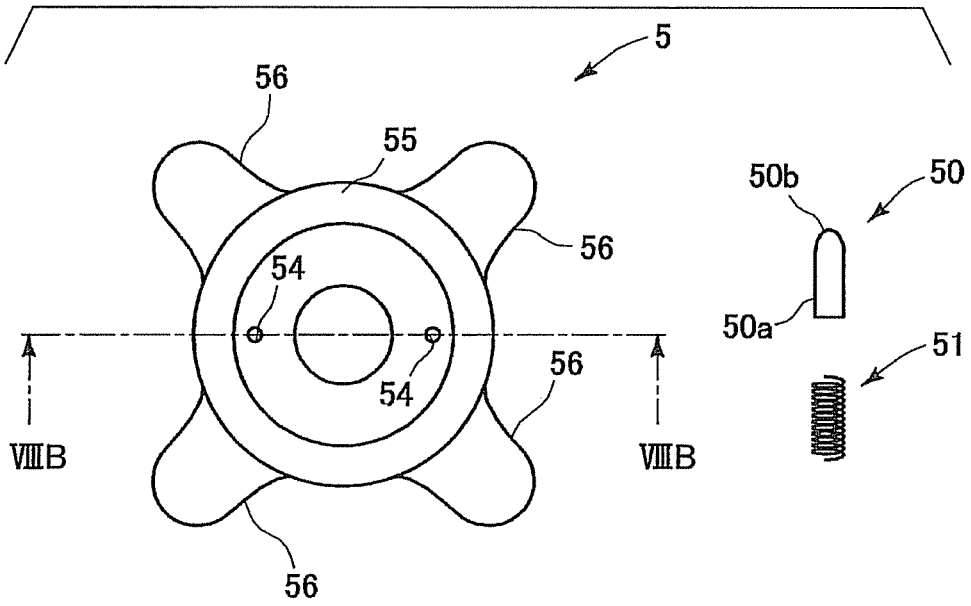
FIG. 8A is a plan view of a swing shaft and FIG. 8B is a cross section taken along the line VIIIB-VIIIB of the swing shaft of FIG. 8A.
Figure 8B:
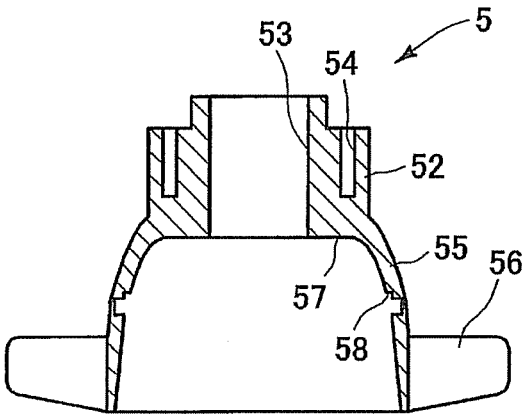

FIG. 8A and FIG. 8B show a plan view and a cross section taken along the line VIIIB-VIIIB, respectively, of the swing shaft 5. The swing shaft 5 includes a ball-like portion 55 of a spherical shape in a lower portion of a cylinder portion 52. Protrusion portions 56 are provided to protrude radially outward from a lower end of the ball-like portion 55 at regular intervals in the circumferential direction.

As has been described above, the cylinder portion 52 is inserted into the outer cylinder portion 32 of the rotation shaft 3. The inner cylinder portion 31 of the rotation shaft 3 is inserted into an inner surface 53 of the cylinder portion 52. A plurality of (for example, two) hole portions 54 extending in an axial direction and spaced apart in the circumferential direction are formed in an upper end face of the cylinder portion 52. The rotation plunger 50 and the rotation spring 51 are inserted into each hole portion 54.

An outer surface of the ball-like portion 55 of the swing shaft 5 can be spaced apart, for example, by about 1 mm from the inner surface of the ball-like portion 33 of the rotation shaft 3. The outer surface of the ball-like portion 55 of the swing shaft 5 is formed in a spherical shape about the tilting center point P. The two hole portions 58 are formed in the inner surface of the ball-like portion 55 to house and fix therein the tip ends of the bar portions 46 and the protrusion portions 47 both of the center shaft 4. The rotation plunger 50 is of a shape provided with a tip end surface 50*b* of a curved surface shape in a circular pillar portion 50*a*. The rotation plunger 50 together with the rotation spring 51 is housed in each hole portion 54 of the swing shaft 5 and pushed upward as shown in the drawing, so that the tip end surface 50*b* abuts on the lower surface of the circular plate portion 30 of the rotation shaft 3.

Figure 9A:
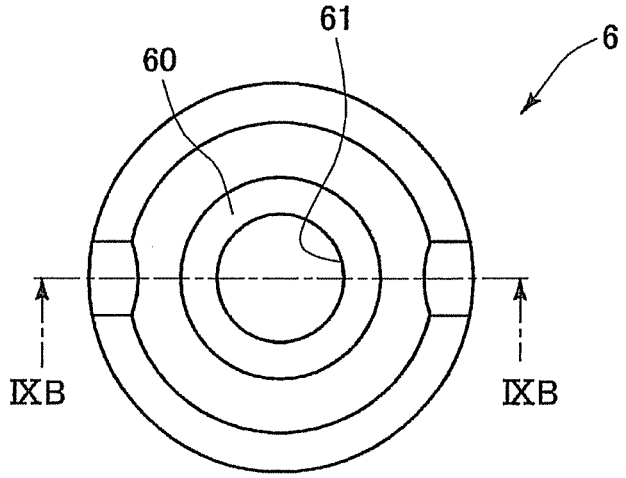
FIG. 9A is a plan view of a slider and FIG. 9B is a cross section taken along the line IXB-IXB of the slider of FIG. 9A.
Figure 9B:
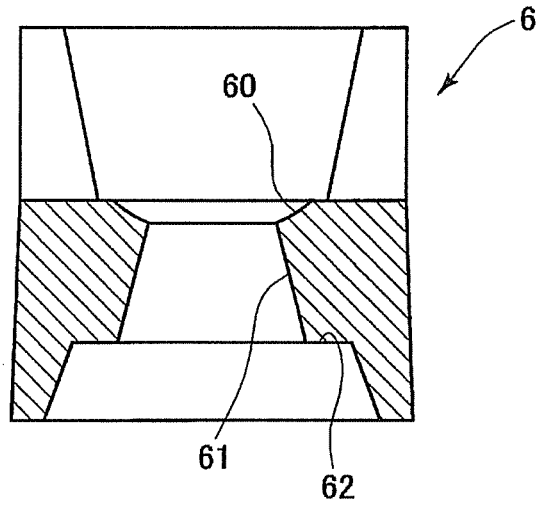

FIG. 9A and FIG. 9B show a plan view and a cross section taken along the line IXB-IXB, respectively, of the slider 6. The slider 6 is of a cylindrical shape provided with a through-hole portion 61 in a top-bottom direction. A portion of the through-hole portion 61 in the vicinity of an upper end forms a ball-like portion 60 hollowed out in a spherical shape. A portion of the through-hole portion 61 in the vicinity of a lower end forms a trapezoidal portion 62 hollowed out in a trapezoidal shape. A diameter of the through-hole portion 61 increases on the lower side as shown in the drawing so as not to interfere with tilting motion of the center shaft 4.

The ball-like portion 60 supports the ball-like portion 43 of the center shaft 4 from below. The tube portion 44 of the center shaft 4 is inserted into the through-hole portion 61. The trapezoidal portion 62 is placed on an upper end face 71 (described below) of the press rubber 7. A shape in which to house the bar portions 46 or the like of the shaft center 4 with a space in between is formed in the ball-like portion 60 on an upper side as shown in the drawing.

Figure 10A:
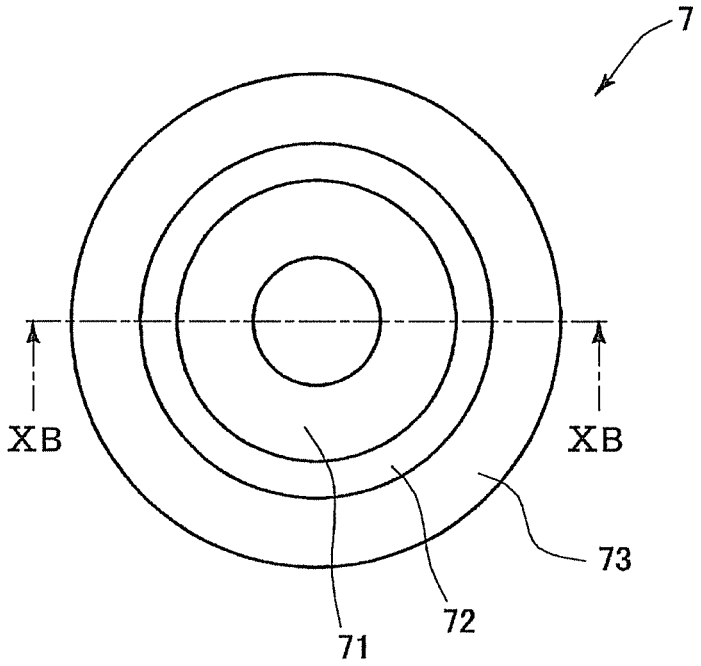
FIG. 10A is a plan view of a press rubber and FIG. 10B is a cross section taken along the line XB-XB of the press rubber of FIG. 10A.
Figure 10B:
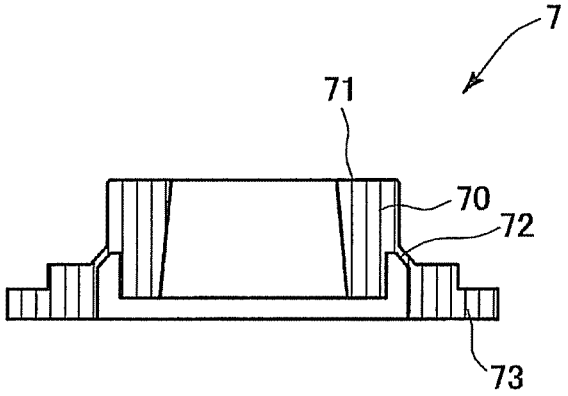

FIG. 10A and FIG. 10B show a plan view and a cross section taken along the line XB-XB, respectively, of the press rubber 7. The press rubber 7 includes a flange portion 73 formed radially outward from a lower end of a cylinder portion 70. A radially inner portion of the flange portion 73 forms a slope portion 72 formed to tilt with respect to the cylinder portion 70. A horizontal surface portion of the trapezoidal portion 62 of the slider 6 is placed on the top surface 71 of the cylinder portion 70 of the press rubber 7. The entire lower end face of the flange portion 73 of the press rubber 7 abuts on the substrate 9 and the radially outward tip end of the flange 73 is inserted into a step portion 84 of the holder 8. A diameter of the inner end face of the cylinder portion 70 increases on the lower side as shown in the drawing so as not to interfere with tilting motion of the center shaft 4.

Figure 11A:
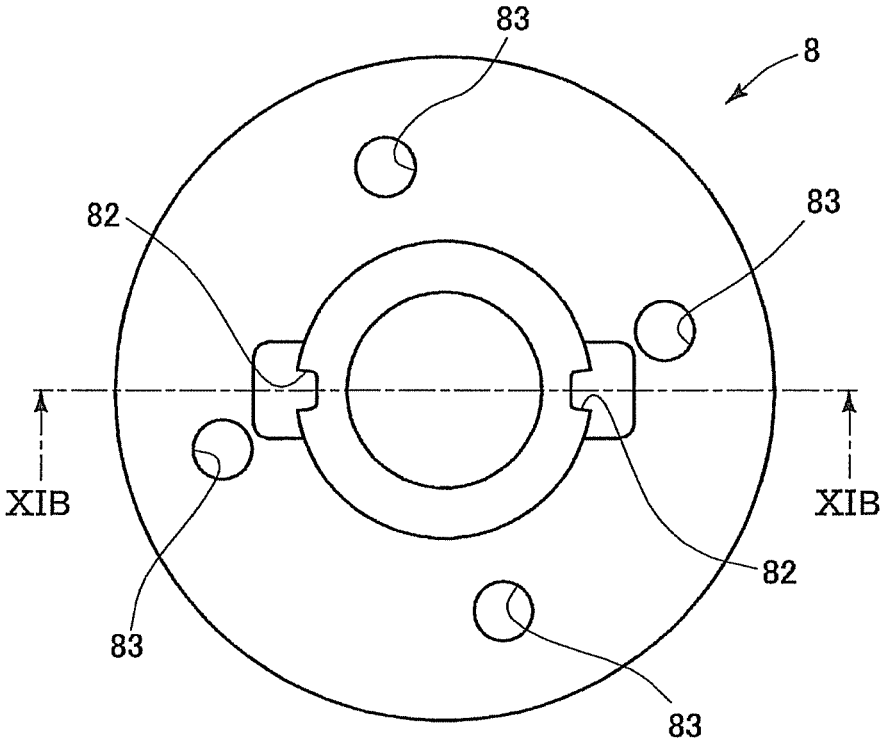
FIG. 11A is a plan view of a holder and FIG. 11B is a cross section taken along the line XIB-XIB of the holder of FIG. 11A.
Figure 11B:
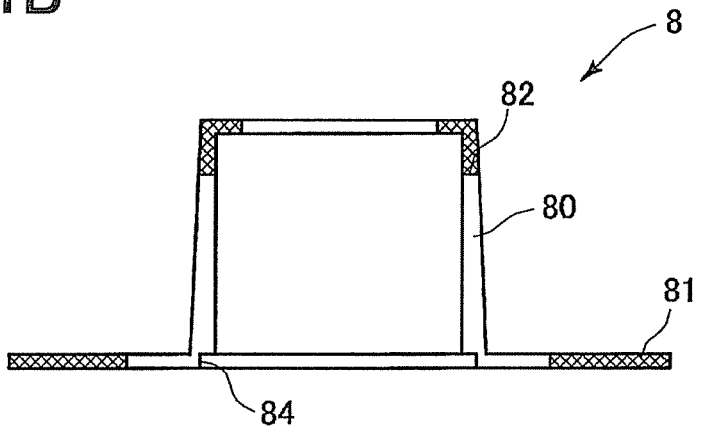

FIG. 11A and FIG. 11B show a plan view and a cross section taken along the line XIB-XIB, respectively, of the holder 8. The holder 8 is of a shape in which a flange portion 81 is provided to extend radially outward from a lower end of a tube portion 80 of a tubular shape. A diameter of the tube portion 80 can be smaller on an upper side. The lengthwise long through-hole portions 82 are provided to the tube 80 in portions on the left and light as shown in the drawing in a one-to-one correspondence. The bar portion 46 of the center shaft 4 is inserted into each through-hole portion 82. The flange portion 81 is provided with hole portions 83 at intervals in a circumferential direction. Protrusion portions 112 (described below) of the case 11 are inserted into the respective hole portions 83. The holder 8 includes the step portion 84 on a lower side as shown in the drawing. The radially outward tip end of the flange portion 73 of the press rubber 7 is inserted into the step portion 84.

Figure 12A:
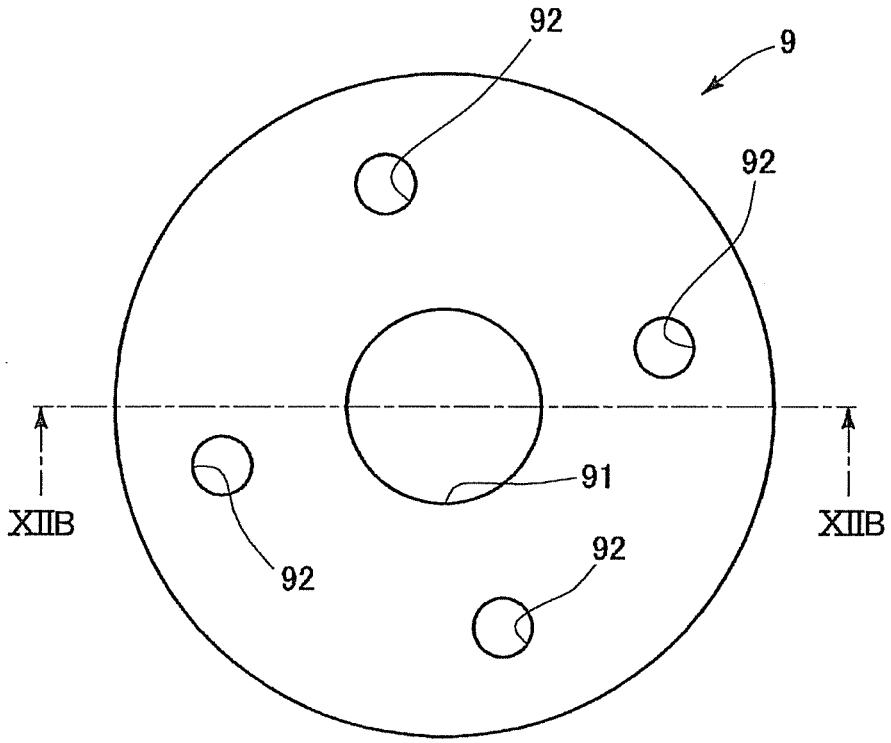
FIG. 12A is a plan view of a substrate and FIG. 12B is a cross section taken along the line XIIB-XIIB of the substrate of FIG. 12A.
Figure 12B:
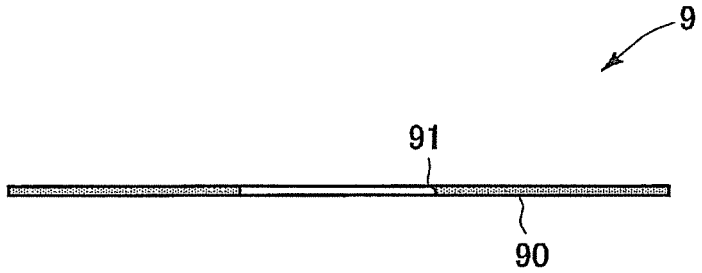

FIG. 12A and FIG. 12B show a plan view and a cross section taken along the line XIIB-XIIB, respectively, of the substrate 9. The substrate 9 is of a disc shape and a lower surface forms a substrate surface 90 on which various elements are disposed. The substrate 9 is provided with a hole portion 91 at a center and hole portions 92 at positions on top of which the respective hole portions 83 of the holder 8 are to be located. The center shaft 4 is inserted into the hole portion 91. The protrusion portions 112 (described below) of the case 11 are inserted into the respective hole portions 92.

Figure 13A:
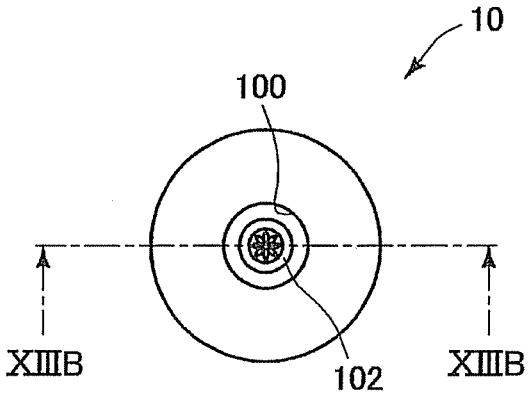
FIG. 13A is a plan view of a click plate and FIG. 13B is a cross section taken along the line XIIIB-XIIIB of the click plate of FIG. 13A.
Figure 13B:
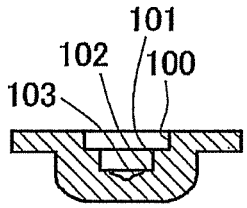

FIG. 13A and FIG. 13B show a plan view and a cross section taken along the line XIIIB-XIIIB, respectively, of the click plate 10. The click plate 10 is provided with a concave portion opening upward and placed on a top surface of the case 11 at a center thereof. As the tip end (lower tip end) of the oscillation plunger 40 abuts on the inside of the concave portion, the click plate 10 plays a role of, for example, allowing the center shaft 4 to stay at the center position in a stable manner.

The concave portion of the click plate 10 is chiefly of a triple-layer structure in a circular shape in cross section in a direction perpendicular to the vertical axis line V. More specifically, the concave portion of the click plate 10 is formed of, from top to bottom, a large diameter cylinder portion 100 of a cylindrical shape having a large diameter, a small diameter cylinder portion 101 of a cylindrical shape having a small diameter, and the concave surface 103 having a surface chiefly of a curved surface shape. The large diameter cylinder portion 100 is formed to prevent the click plate 10 from interfering with tilting motion of the center shaft 4 while the user is performing a tilting operation.

The tube portion 44 of the center shaft 4 is inserted into the small cylinder portion 101 with an end face 102 in the horizontal direction at the top while the user is performing a shaft pushing operation. The concave surface 103 is a surface across which the tip end (lower end) of the oscillation plunger 40 moves while abutting thereon during a tilting operation by the user.

A shape to guide the tip end of the oscillation plunger 40 is formed in the concave surface 103 (described below). A fixing method of the click plate 10 can be adopted arbitrarily from various methods. For example, the click plate 10 may be fastened to the substrate 9 by tightening screws inserted through unillustrated hole portions.

Figure 14A:
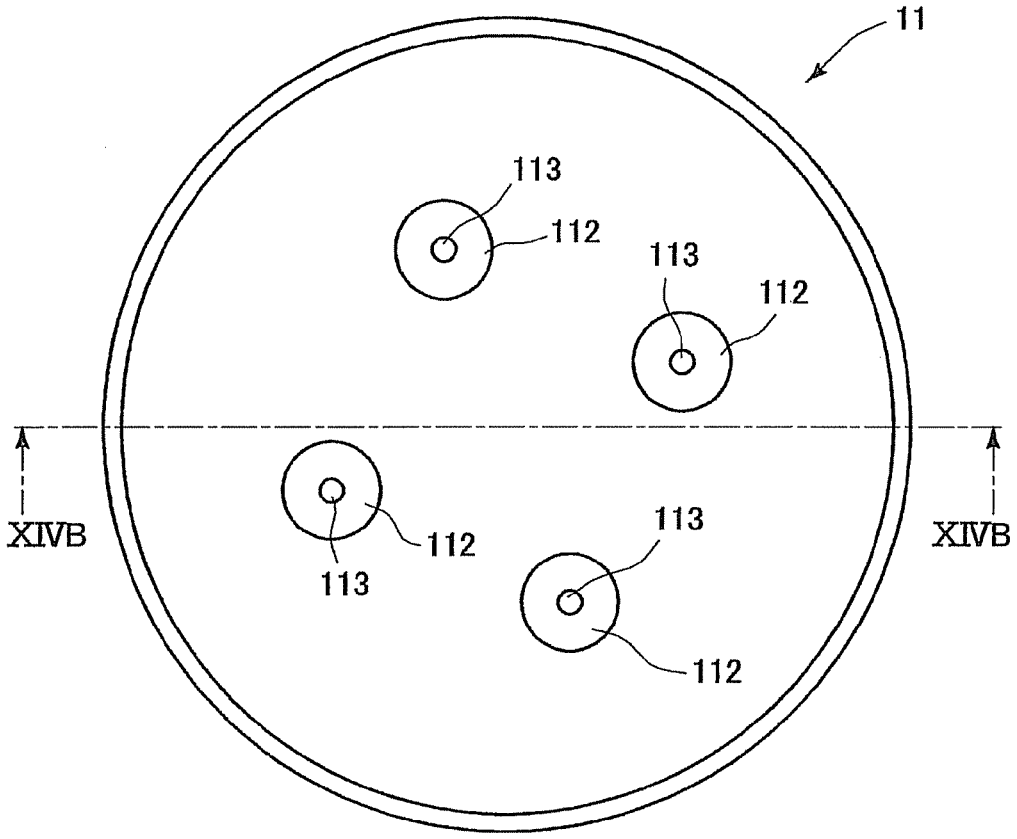
FIG. 14A is a plan view of a cover and FIG. 14B is a cross section taken along the line XIVB-XIVB of the cover of FIG. 14A.
Figure 14B:
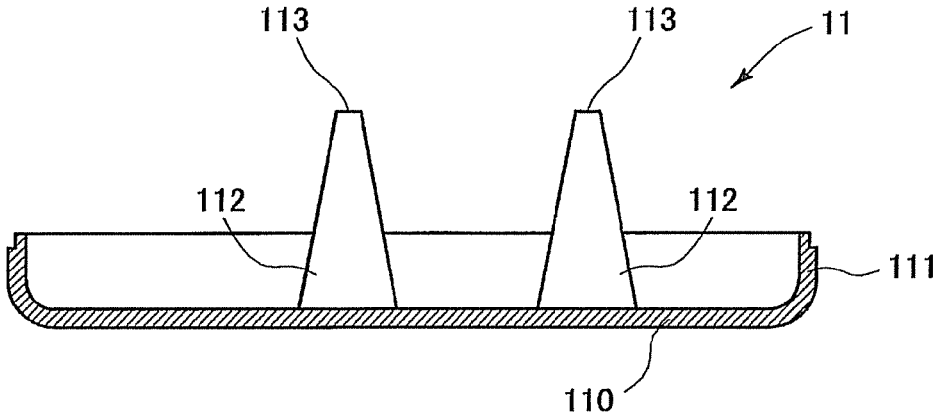

FIG. 14A and FIG. 14B show a plan view and a cross section taken along the line XIVB-XIVB, respectively, of the cover 11. The cover 11 is a member that covers the device 1 from behind (a side invisible to the user when installed to the vehicle). The cover 11 includes a cylinder portion 111 formed from a radial end portion of a bottom surface 110. A plurality of the protrusion portions 112 are formed on the bottom surface 110 so as to protrude upward. The protrusion portions 112 are disposed by penetrating through the respective hole portions 84 of the holder 8 and the respective hole portions 92 of the substrate 9. The lower end face of the flange portion 34 of the rotation shaft 3 abuts on abutment surfaces 113 while the user is performing a shaft pushing operation, so that overweighting on the upper end faces of the protrusion portions 112 is suppressed.

Figure 15A:
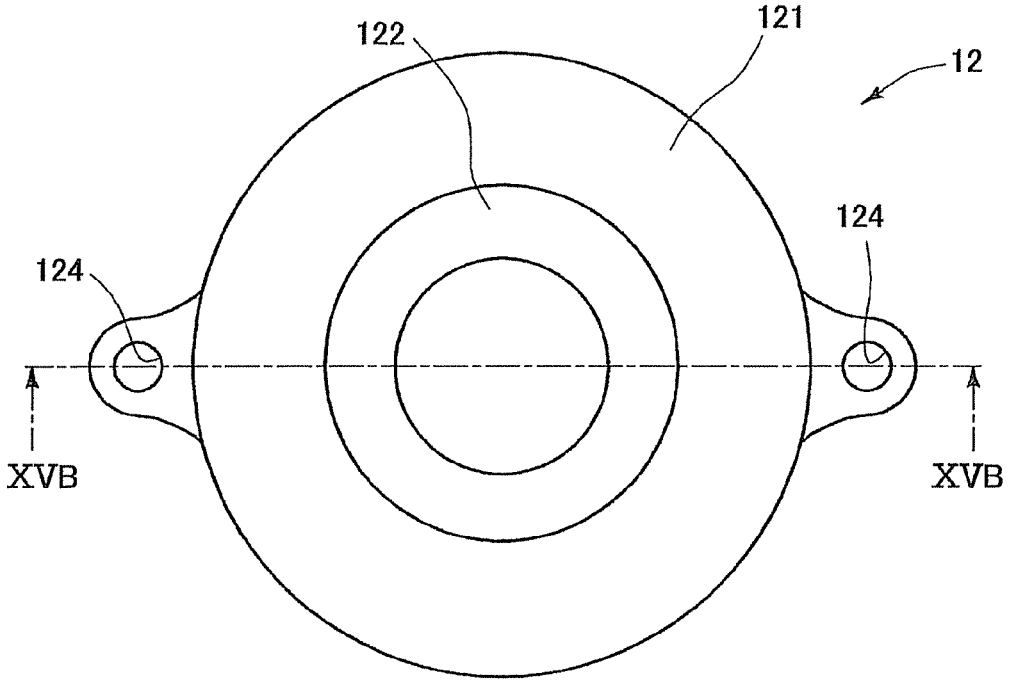
FIG. 15A is a plan view of a case and FIG. 15B is a cross section taken along the line XVB-XVB of the case of FIG. 15A.
Figure 15B:
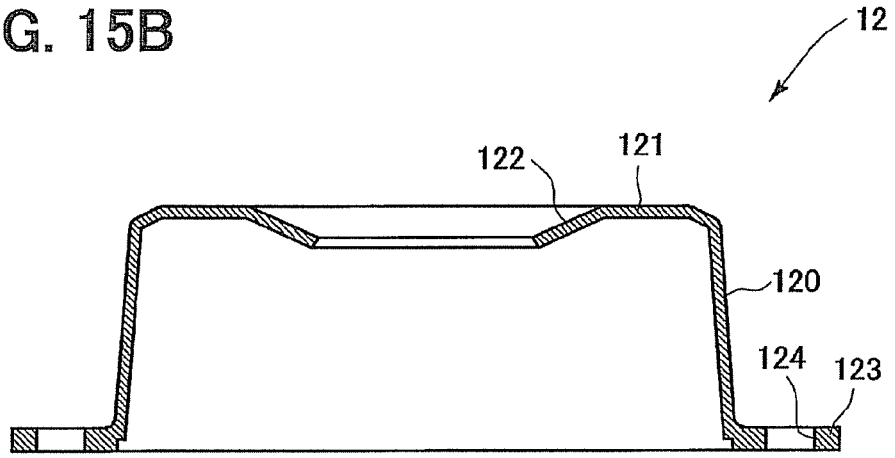

FIG. 15A and FIG. 15B show a plan view and a cross section taken along the line XVB-XVB, respectively, of the case 12. The case 12 is a member that covers a body portion (portion other than the knob 2) of the device 1. The case 12 includes a cylinder portion 120 of a cylindrical shape that covers the device interior from radially outward and a circular plate portion 121 of chiefly a disc shape that covers the device interior from above in the axial direction. A radially inner portion of the circular plate portion 121 forms a slope portion 122 tilting downward. Protrusion portions 123 protruding in a left-right direction as shown in the drawing are formed at a lower end of the cylinder portion 120. The case 12 (and hence the device 1) can be fixed to the interior of the vehicle, for example, by tightening screws inserted into hole portions 124 provided to the respective protrusion portions 123.

Figure 16A:
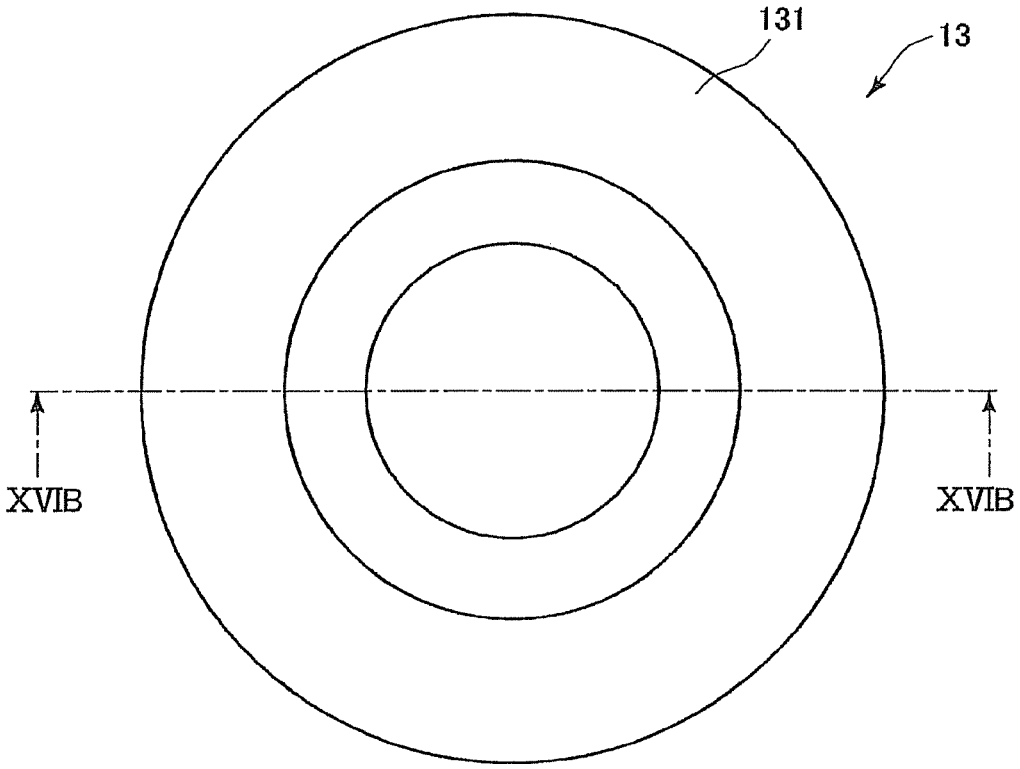
FIG. 16A is a plan view of an upper housing and FIG. 16B is a cross section taken along the line XVIB-XVIB of the upper housing of FIG. 16A.
Figure 16B:
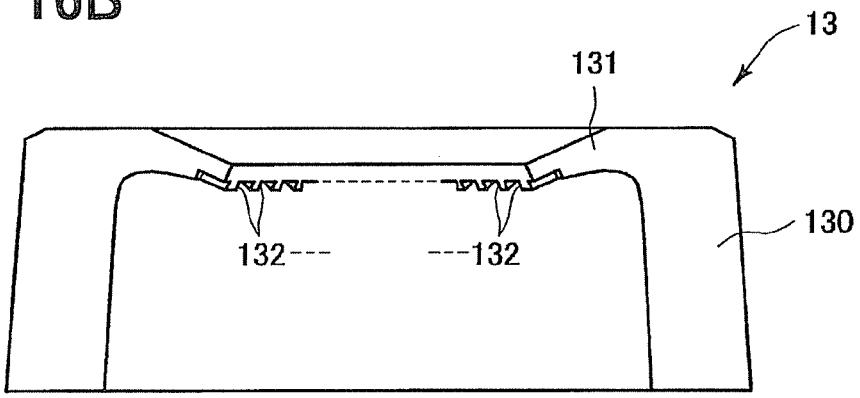

FIG. 16A and FIG. 16B show a plan view and a cross section taken along the line XVIB-XVIB, respectively, of the upper housing 13. The upper housing 13 is of a shape in which a fold-back portion 131 is formed by folding an upper end portion in the axil direction of a cylinder portion 130 of a cylindrical shape radially inward. In a case where the user performs a tilting operation, a part of the flange portion 34 of the rotation shaft 3 that rises by tilting motion abuts on the lower end face of the fold-back portion 131 and the tilting motion is stopped.

Groove portions 132 are formed in the lower end face of the fold-back portion 131. Individual grooves of the groove portions 132 are formed to extend radially outward from the radially inner end portion of the fold-back portion 131 in such a manner that these grooves are aligned all along the circumference of the fold-back portion 131. The groove portions 132 on the lower end face of the fold-back portion 131 fit to the ribs 36 formed in the flange portion 34 of the tilting rotation shaft 3.

This fitting suppresses rotations of the rotation shaft 3 while the rotation shaft 3 is brought into a tilting state by a tilting operation by the user. Hence, unintended rotation motion is suppressed while the user is performing a tilting operation. The user thus becomes able to perform the tilting operation in a reliable manner.

A tilting (oscillation) operation, a shaft pushing operation, and a rotation (turning) operation of the device 1 configured as above will now be described more in detail. It should be appreciated that the holder 8, the substrate 9, the click plate 10, the cover 11, the case 12, and the upper housing 13 are in a fixed state (for example, in the interior of the vehicle) and do not undergo any motion in response to any of the operations specified above.

A tilting (oscillation) operation will be described first. FIG. 17 shows a state where a tilting operation to the right as shown in the drawing is performed on the device 1 shown in FIG. 4. When the user performs a tilting (oscillation) operation, that is, an operation to tilt the operation axis line L by holding the knob 2, as is shown in FIG. 17, the knob 2, the rotation shaft 3, the center shaft 4, and the swing shaft 5 tilt in a direction in which the tilting operation was performed. As has been described, the inner end face of the through-hole portion 61 of the slider 6 and the inner end face of the cylinder portion 70 of the press rubber 7 are tilted with respect to the vertical axis line V so as not to interfere with tilting motion of the center shaft 4. A tilting operation is rotational motion about the tilting center point P. During tilting motion, the ball-like portion 43 of the center shaft 4 slides on the ball-like portion 60 of the slider 6 whereas the ball-like portion 55 of the swing shaft 5 slides on the inner end face of the fold-back portion 131 of the upper housing 13.

By a tilting operation, the tip end (lower end) of the oscillation plunger 40 being pushed downward as shown in the drawing by the oscillation spring 41 glides within the concave surface 103 of the click plate 10. A guide portion 104 that guides the tip end of the oscillation plunger 40 in a predetermined tilting direction during a tilting operation is formed in the concave surface 103. This configuration will be descried in detail below.

A tilting operation is stopped as a portion of the flange portion 34 of the rotation shaft 3 on a side opposite to the direction of the tilting operation (a side rising by the tilting motion) abuts on the lower end face of the fold-back portion 131. Upon this abutment, the ribs 36 formed in the flange portion 34 of the rotation shaft 3 and the groove portions 132 formed in the upper housing 13 are fit to each other. Consequently, rotational motion during the tilting operation is suppressed.

Figure 24A:
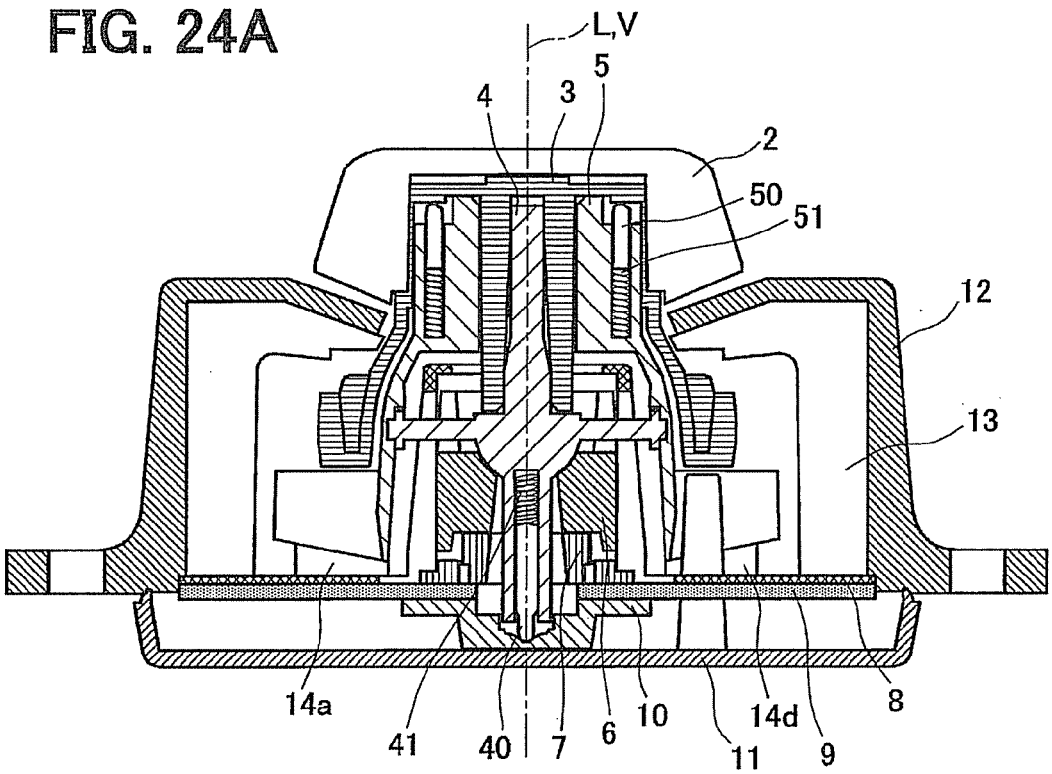
FIG. 24A and FIG. 24B are views showing the operation input device during a shaft pushing operation.
Figure 24B:
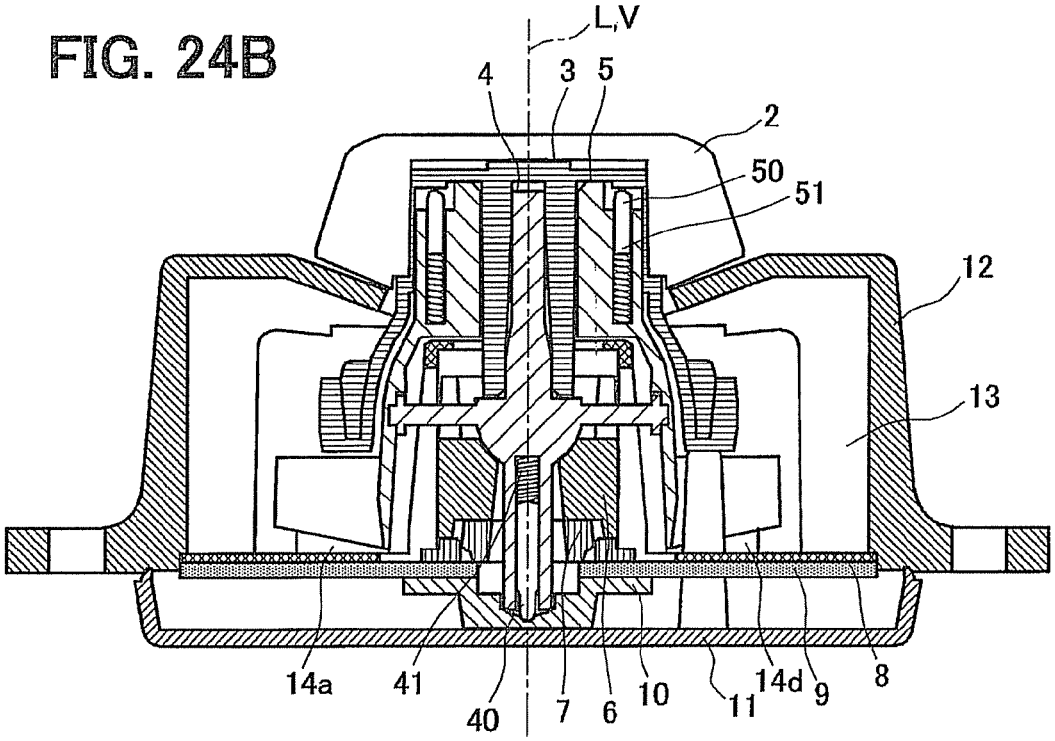

A shaft pushing operation will now be described. FIG. 24A and FIG. 24B show a state where a shaft pushing operation is performed on the device 1 of FIG. 4. When the user performs a shaft pushing operation, that is, an operation to push the knob 2 downward as shown in the drawing, as are shown in FIG. 24A and FIG. 24B, the knob 2, the rotation shaft 3, the center shaft 4, the swing shaft 5, and the slider 6 move downward in a parallel direction.

In this instance, the press rubber 7 made of rubber undergoes deformation due to elasticity of rubber. As an amount of shaft pushing (a distance over which the center shaft 4 moves downward as shown in the drawing in a parallel direction) increases from zero, the press rubber 7 gradually undergoes deformation. When an amount of shaft pushing exceeds a certain amount, as are shown in FIG. 24A and FIG. 24B, the slope portion 72 of the press rubber 7 rapidly undergoes considerable deformation. This considerable deformation makes the user have a clicking feeling.

Figure 25A:
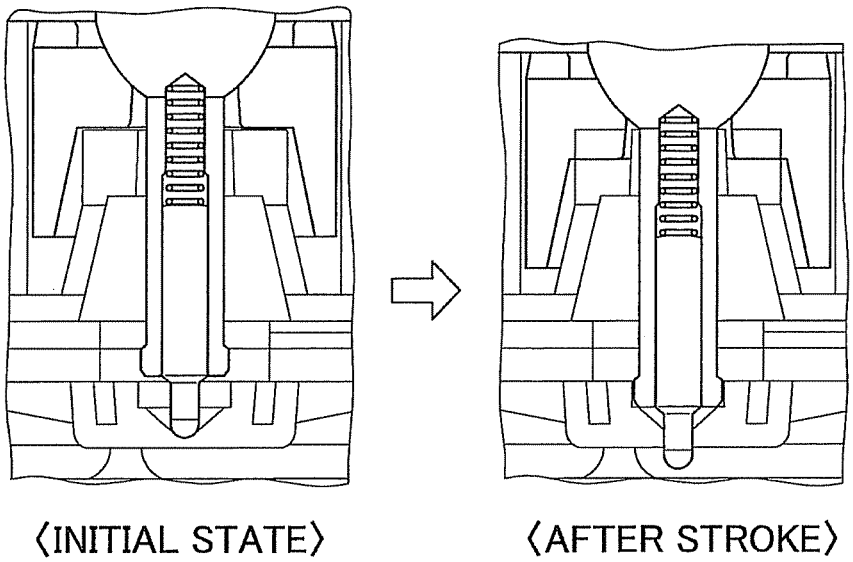
FIG. 25A and FIG. 25B are views showing the operation input device during the shaft pushing operation in detail.
Figure 25B:
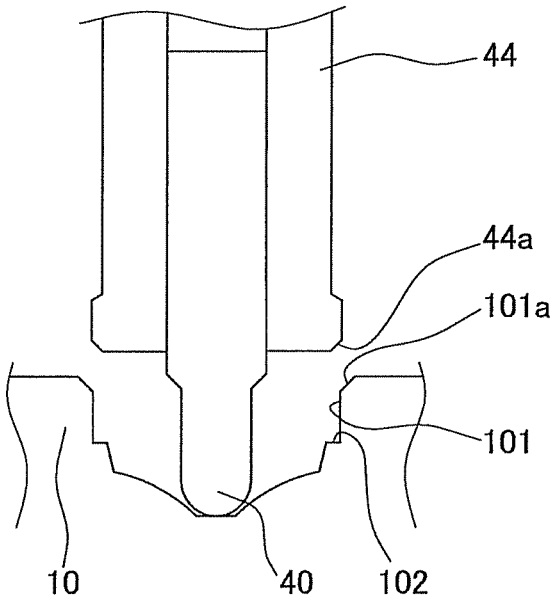

When the tube portion 44 of the center shaft 4 moves downward in a parallel direction by the shaft pushing operation, as are shown in FIG. 25A and FIG. 25B, the tube portion 44 is inserted into the small diameter tube portion 101 of the click plate 10. A size (diameter) of the tube portion 44 is set slightly smaller than a size (diameter) of the small diameter tube portion 101. Accordingly, once the tube portion 44 is inserted into the small diameter cylinder portion 101, the tube portion 44 is no longer allowed to tilt. Owing to this configuration, undesirable tilting motion is suppressed while the user is performing a shaft pushing operation and the user becomes able to perform the shaft pushing operation in a reliable manner.

A rotation (turning) operation will now be described. When the user performs a turning operation, that is, an operation to rotate the knob 2 about the operation axis line L, the knob 2 and the rotation shaft 3 are turned. Even when the bar portions 46 of the center shaft 4 are forced to rotate, the bar portions 46 are stopped by the holder 8 that is disposed fixedly. Hence, the center shaft 4 is not turned. Accordingly, the swing shaft 5 to which the tip ends of the bar portions 46 of the center shaft 4 are fixed is not turned, either. Likewise, the slider 6 and the press rubber 7 are not turned.

As has been described, the convex portions 35 are formed, as are shown in FIG. 6A through FIG. 6C, on the lower surface of the rotation shaft 3. When the user performs a turning operation on the knob 2, the turning plungers 50 undergo motion in a top-bottom direction. Because the turning plungers 50 are pushed upward by the turning springs 51, the turning plungers 50 are pressed downward more forcefully where the convex portions 35 are present than where the convex portions 35 are absent.

Owing to this configuration, a turning angle of the knob 2 by a turning operation on the knob 2 is stabilized at a position between the convex portions 35. FIG. 6C shows stabilized positions 35*a* each between the convex portions 35. Because the convex portions 35 are formed at regular intervals in a circumferential direction, the stabilized positions 35*a* are also disposed at regular intervals in the circumferential direction. Turning of the knob 2 is stabilized at the stabilized positions 35*a*. The knob 2 is therefore turned by an angle between the adjacent stabilized positions 35*a* at a time.

Figure 18:
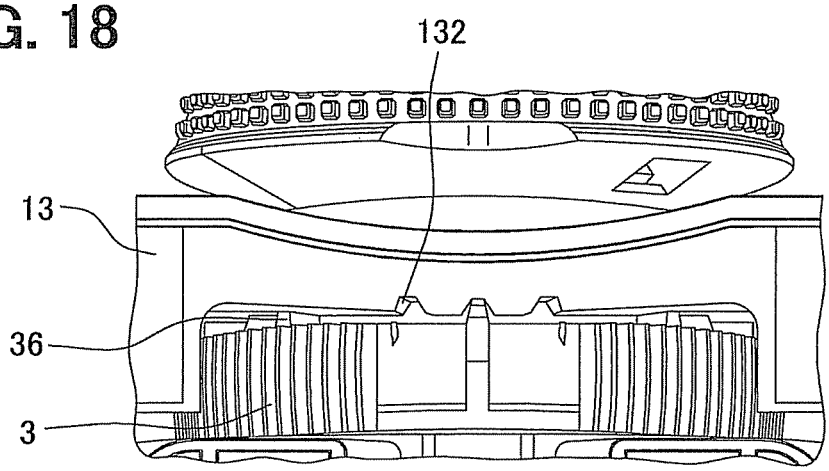
FIG. 18 is a view showing a fitting state during the tilting operation when viewed from sideways.
Figure 19:
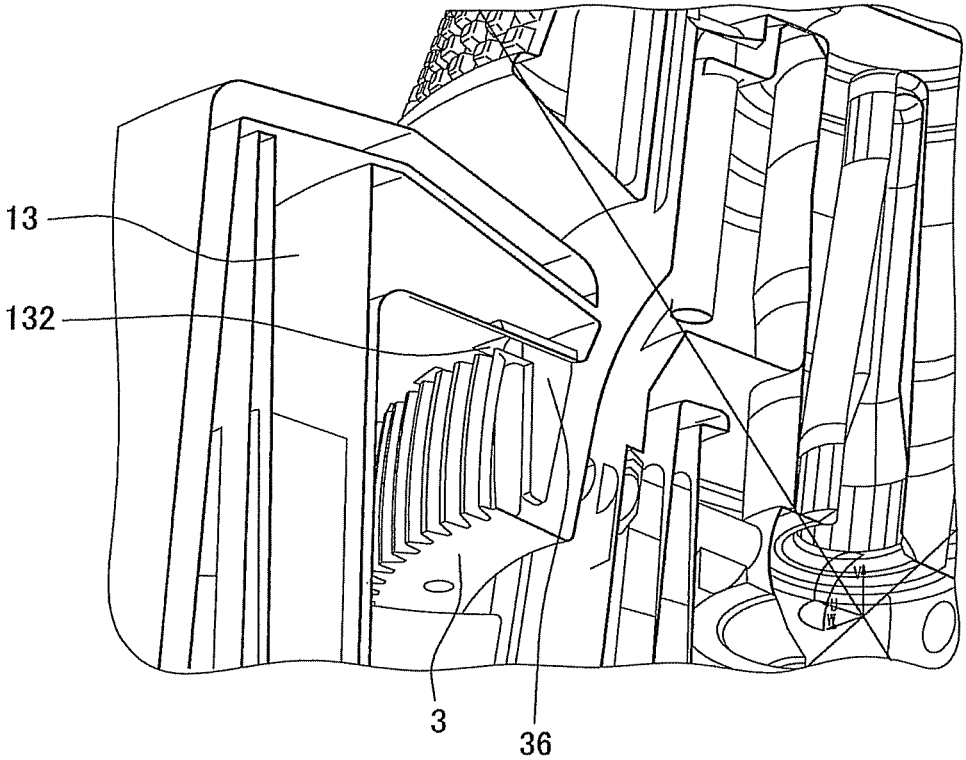
FIG. 19 is a view showing the fitting state during the tilting operation when viewed from below.

The device 1 will be described more in detail in the following. FIG. 18 and FIG. 19 show a manner in which the rib 36 of the rotation shaft 3 and the groove portions 132 of the upper housing 13 are fit to each other. As has been described, the flange portion 34 of the rotation shaft 3 is provided with the ribs 36 at regular intervals, in the circumference direction. Likewise, the upper housing 13 is provided with the groove portions 132 at regular intervals in the circumferential direction.

In an example of FIG. 16A and FIG. 16B, eight ribs 36 are formed at regular intervals in the circumferential direction and 24 groove portions 132 are formed at regular intervals in the circumferential direction. The number of the groove portions 132 is equal to the number of the stabilized positions 35*a* in one turn. The ribs 36 and the groove portions 132 are formed at positions at which the former and the latter fit to each other when the knob 2 and the rotation shaft 3 are tilted while turning motion thereof is stabilized at the stabilized position 35*a*. In the operation input device 1, the number of oscillation directions (8) is a divisor of the number of rotational clicks in one turn (24). When the number of oscillation directions and the number of one-turn rotational clicks do not satisfy this condition, the ribs 36 and the groove portions 132 do not fit to each other during a tilting operation. In the operation input device 1, the number of oscillation directions and the number of one-turn rotational clicks can be changed from 8 and 24, respectively. However, the condition that the former be a divisor of the latter has to be satisfied in this case, too.

Figure 20:
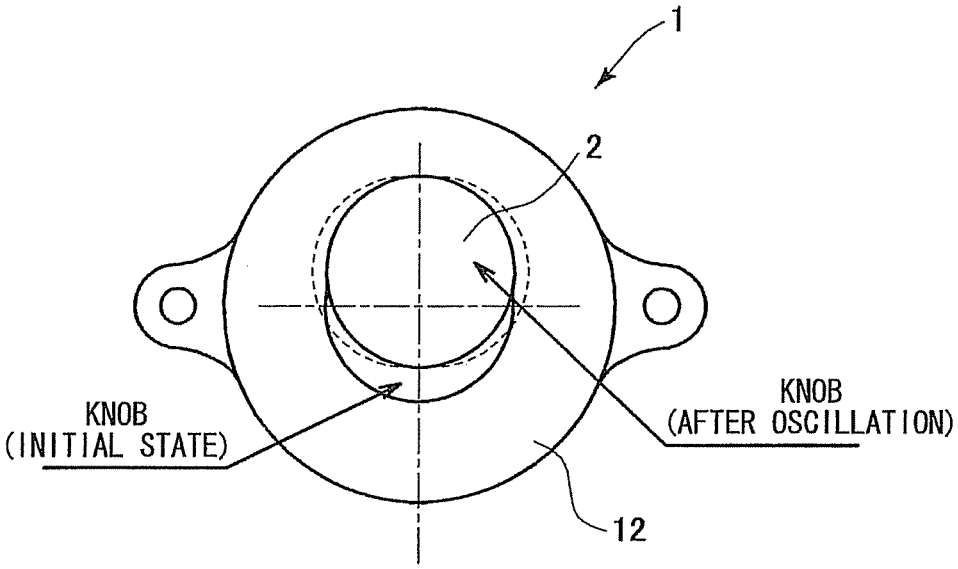
FIG. 20 is a view showing a manner of rotation during the tilting operation.

As the ribs 36 and the groove portions 132 fit to each other during a tilting operation, rotation motion of the knob 2 and the rotation shaft 3 in a tilting state is inhibited or suppressed. In an operation input device in the related art shown in FIG. 20, rotation motion undesirable for the user occurs during tilting motion in some cases. In particular, depending on a manner in which a force is applied, the knob rotates or collapses after the knob is oscillated. In contrast, in the operation input device 1 of this embodiment, because rotations during tilting motion are suppressed, operation performance during tilting motion is stabilized and an erroneous operation is suppressed.

Figure 23:
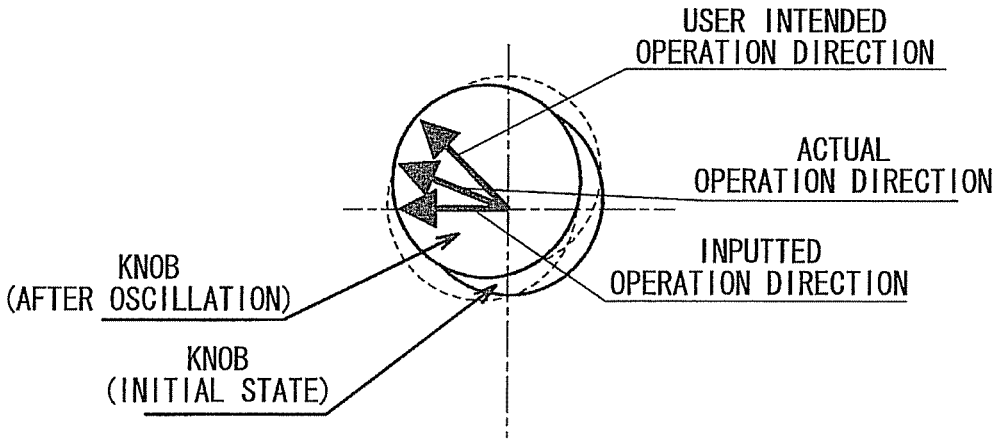
FIG. 23 is a view showing an example of a desired direction and an actual direction during the tilting operation.

FIG. 21A through FIG. 21D show the guide portion 104 formed in the concave surface 103 of the click plate 10. As is shown in FIG. 23, with the operation input device in the related art, when the user performs a tilting (oscillation) operation, an operational feeling is ambiguous and there is a possibility of an erroneous operation because the knob is not actually tilted in an intended, tilting direction. In other words, in response to an input of an operation direction, a direction unintended by the user is inputted in some cases. Herein, the guide portion 104 is a region that lowers a possibility of an erroneous operation by providing a distinct operational feeling for a tilting operation owing to a shape of a portion of the concave surface 103 of the click plate 10 on which the oscillation plunger 40 pushed by the oscillation spring 41 abuts.

The guide portion 104 is a convex portion formed on the concave surface 103 in such a manner that the tip end (lower end) of the oscillation plunger 40 abuts thereon and is guided appropriately in a predetermined tilting, direction during a tilting operation. In an example of FIG. 21A through FIG. 21D, there are eight predetermined tilting directions set by dividing the entire circumference about the vertical axis line V by 8.

The guide portion 104 includes a ring-like convex portion 106 surrounding, in a circumferential direction, an outer rim of a position at which the tip end of the oscillation plunger 40 abuts in a non-tilting state (that is, a state where the operation axis line L agrees with the vertical axis line V as in FIG. 4) and linear convex portions 105 formed radially outward from the ring-like convex portion 106 in a radial fashion in eight boundaries of the respective eight predetermined tilting directions.

Figure 21A:
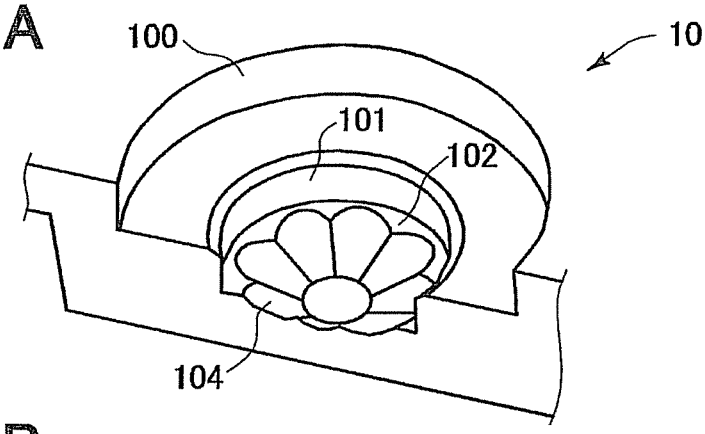
FIG. 21A is a perspective view of the click plate.
Figure 21B:
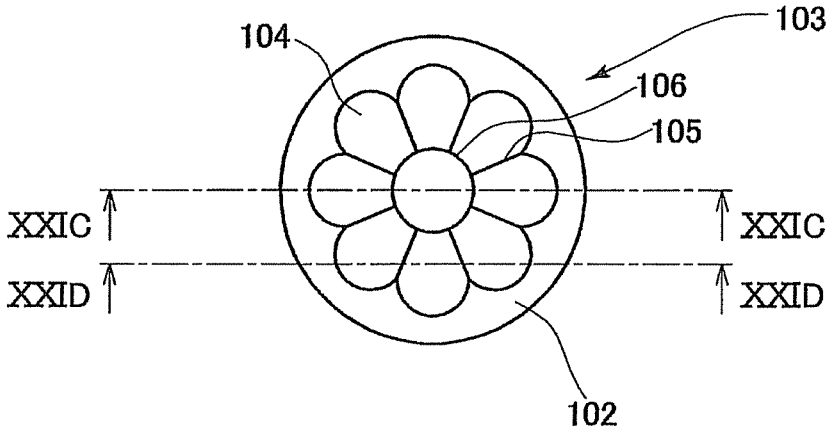
FIG. 21B is a bottom view of the click plate.
Figure 21C:
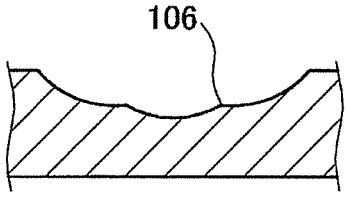
FIG. 21C is a cross section taken along the line XXIC-XXIC of the click plate of FIG. 21B.

As is shown in the cross section taken along the line XXIC-XXIC of FIG. 21C, the ring-like convex portion 106 can be, for example, of a shape protruding from the click plate 10 to have a ring-like ridge and a region surrounded by the ring-like convex portion 106 can form a smooth concave portion of a curved surface shape. In a case where the user performs a tilting operation on the knob 2 in a non-tilting state, the user has a clicking feeling at hand when the tip end of the oscillation plunger 40 surmounts the ring-like convex portion 106. With this clicking feeling, the user can confirm that the knob 2 is brought into a tilting state.

Figure 21D:
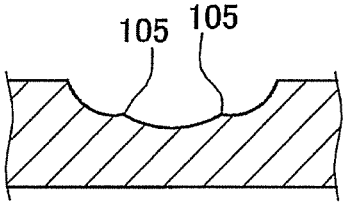
FIG. 21D is a cross section taken along the line XXID-XXID of the click plate of FIG. 21B.

Also, as are shown in the cross sections taken along the lines XXIC-XXIC and XXID-XXID of FIG. 21C and FIG. 21D, respectively, the linear convex portions 105 can be, for example, of a shape protruding from the click plate 10 so as to have a linear ridge and a region sandwiched between the linear convex portions 105 can form a smooth concave portion of a curved surface shape.

Figure 22:
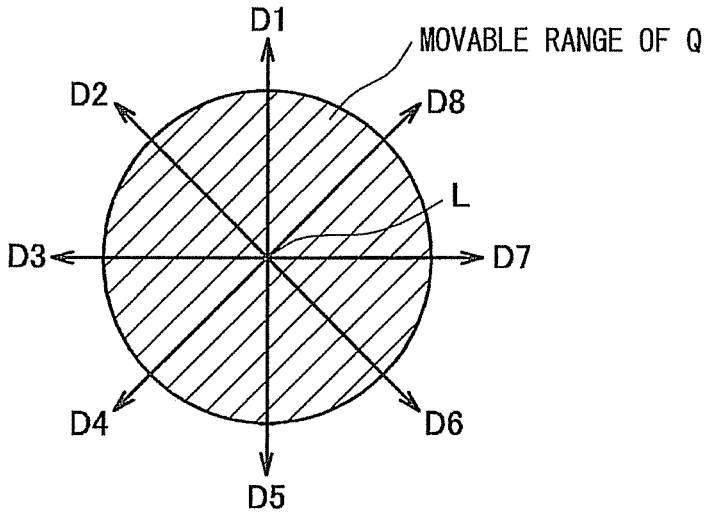
FIG. 22 is a view showing a movable range during the tilting operation.

In a case where the user performs a tilting operation on the knob 2, the eight directions divided by the eight linear convex portions 105 are the appropriate tilting directions. The eight directions D1 through D8 are shown in FIG. 22. Because the linear convex portions 105 are formed on the both sides of each of the eight tilting directions D1 through D8, the user can tilt the knob 2 in a desired tilting direction in a stable manner.

It should be appreciated, however, that an operation direction allowed by the tilting operation on the knob 2 by the user is not limited to the eight directions D1 through D8 defined by the linear convex portions 105. Herein, let a point Q be an intersection of the operation axis line L and the top surface 20 of the knob 2, then FIG. 22 shows a movable range of the point Q by a tilting operation by the user. In short, the movable range of the point Q is the entire inside of a circle shown in FIG. 22.

The outer rim of the movable range shown in FIG. 22 corresponds to a tilting angle in a state where the tilting motion is stopped as the tilting rotation shaft 3 abuts on the upper housing 13 (the ribs 36 and the groove portions 132 fit to each other as described above). When the user performs a tilting operation on the knob 2, the device 1 allows the user to move to an adjacent tilting direction (for example, to move from the direction D1 to the direction D2). For example, the user can perform a tilting operation in such a manner that the point Q undergoes circular motion about the vertical axis line L.

In this instance, when the tip end of the oscillation plunger 40 surmounts the linear convex portion 105, the user has a clicking feeling at the hand. With this clicking feeling, the user can confirm that the knob 2 has shifted to the adjacent tilting direction. Hence, in a case where the user changes the tilting directions, the user can confirm in a reliable manner that the tilting directions have been actually changed. Also, in a case where the user has no clicking feeling provided when the tilting direction shifts to the adjacent direction, the user can confirm in a reliable manner that he is successfully performing the operation in the desired tilting direction. Herein, in order to allow the oscillation plunger 40 to glide on the guide portion 104, an R of the concave shape of the guide portion is set larger than an R of the tip end surface 40*d* of the oscillation plunger 40.

A shaft pushing operation of the device 1 will now be described. The device 1 during a shaft pushing operation is shown in FIG. 24A, FIG. 24B, FIG. 25A, and FIG. 25B. FIG. 24A and FIG. 24B are overall views and FIG. 25A and FIG. 25B are partially enlarged views. As has been described, the knob 2, the rotation shaft 3, the center shaft 4, the swing shaft 5, and the slider 6 move downward in a parallel direction by a shaft pushing operation by the user. In this instance, the press rubber 7 made of rubber undergoes deformation due to elasticity of rubber.

As an amount of shaft pushing (a distance over which the center shaft 4 moves downward as shown in the drawing in a parallel direction) increases from zero, the press rubber 7 gradually undergoes deformation. When an amount of shaft pushing exceeds a certain amount, as are shown in FIG. 24A and FIG. 24B, the slope portion 72 of the press rubber 7 rapidly undergoes considerable deformation (buckling). This considerable deformation provides the user with a clicking feeling.

The click plate 10 is provided with the small diameter cylinder portion 101. As the center shaft 4 is pushed downward, the cylinder portion 44 of the center shaft 4 is inserted into the small diameter cylinder portion 101 and fit therein. FIG. 24A shows a state where the shaft pushing operation is at a halfway stage and FIG. 24B and a right side of FIG. 25A show a state where the center shaft 1 is fully pushed (one stroke completed state). The stage of FIG. 24A shows a state where the center shaft 4 is stroked by 1.5 mm. The slope portion 72 of the press rubber 7 then buckles and the bottom surface of the cylinder portion 70 abuts on the substrate 9 in the top surface as shown in the drawing. FIG. 24B shows a state where the shaft pushing operation is performed further (for example, the center shaft 4 is stroked by 2 mm). The press rubber 7 then undergoes further deformation to the extent that the abutment surfaces 113 of the respective protrusion portions 112 of the cover 11 abut on the bottom surface of the flange portion 34 of the rotation shaft 3 and the shaft pushing motion is eventually stopped. From this, the user becomes aware in a reliable manner that the center shaft 4 has been fully pushed.

A size (diameter) of the small diameter cylinder portion 101 is set as large as or slightly larger than a size (diameter) of the cylinder portion 44, so that the cylinder portion 44 does not tilt while the cylinder portion 44 is inserted into the small diameter cylinder portion 101. Owing to this configuration, the center shaft 4 and further the knob 2 are stabilized when the shaft pushing operation is performed and tilting motion during the shaft pushing operation is suppressed. As are shown in FIG. 25A and FIG. 25B, it is preferable to form either a chamfered portion 44*a* (or ft-shaped portion) at a corner of the cylinder portion 44 or a chamfered portion 101*a* (or ft-shaped portion) at a corner of the small diameter cylinder portion 101 of the click plate 10 or to form the both, because it becomes easier to insert the cylinder portion 44 into the small diameter cylinder portion 101.

In the operation input device in the related art, the knob is not stabilized while the shaft is pushed and tilts against the user's intention during a shaft pushing operation in some cases. On the contrary, in the device 1, the click plate 10 and the center axis 4 are fit to each other during a shaft pushing operation. Accordingly, there is no feeling of instability with the knob 2 during the shaft pushing operation. Hence, an erroneous operation does not occur by unintended tilting motion during the shaft pushing operation. It thus becomes possible to achieve high operation performance unachievable in the related art.

A detection of the rotation operation, the shaft pushing operation, and the tilting operation by the device 1 will now be described with reference to FIG. 26 through FIG. 29.

Figure 26:
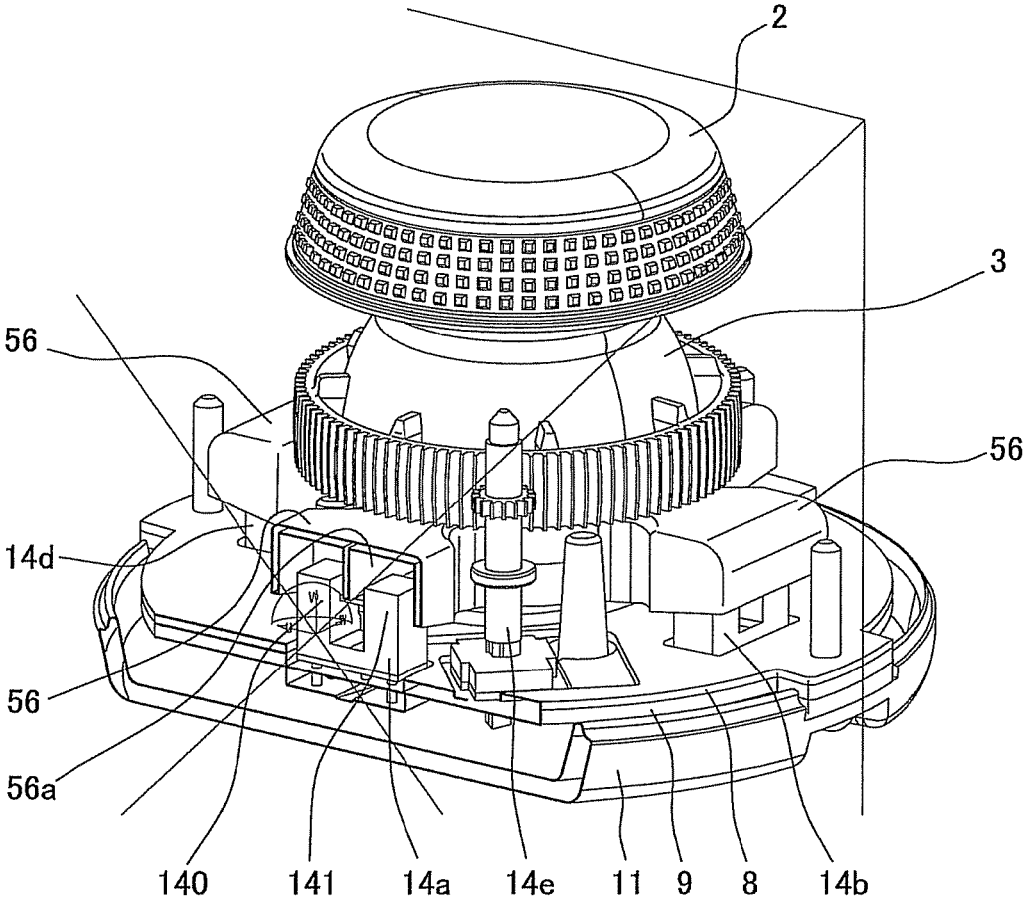
FIG. 26 is a perspective view showing a layout example of photo interrupters.
Figure 27:
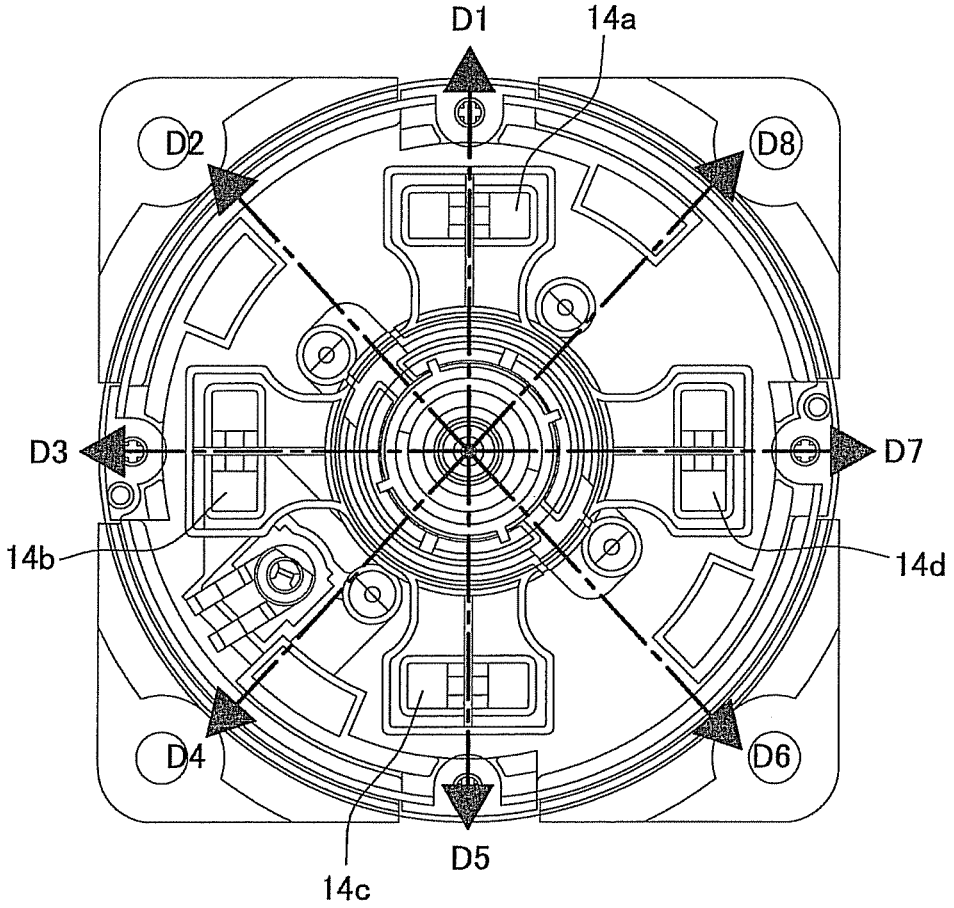
FIG. 27 is a plan view showing a layout, example of the photo interrupters.
Figure 29:
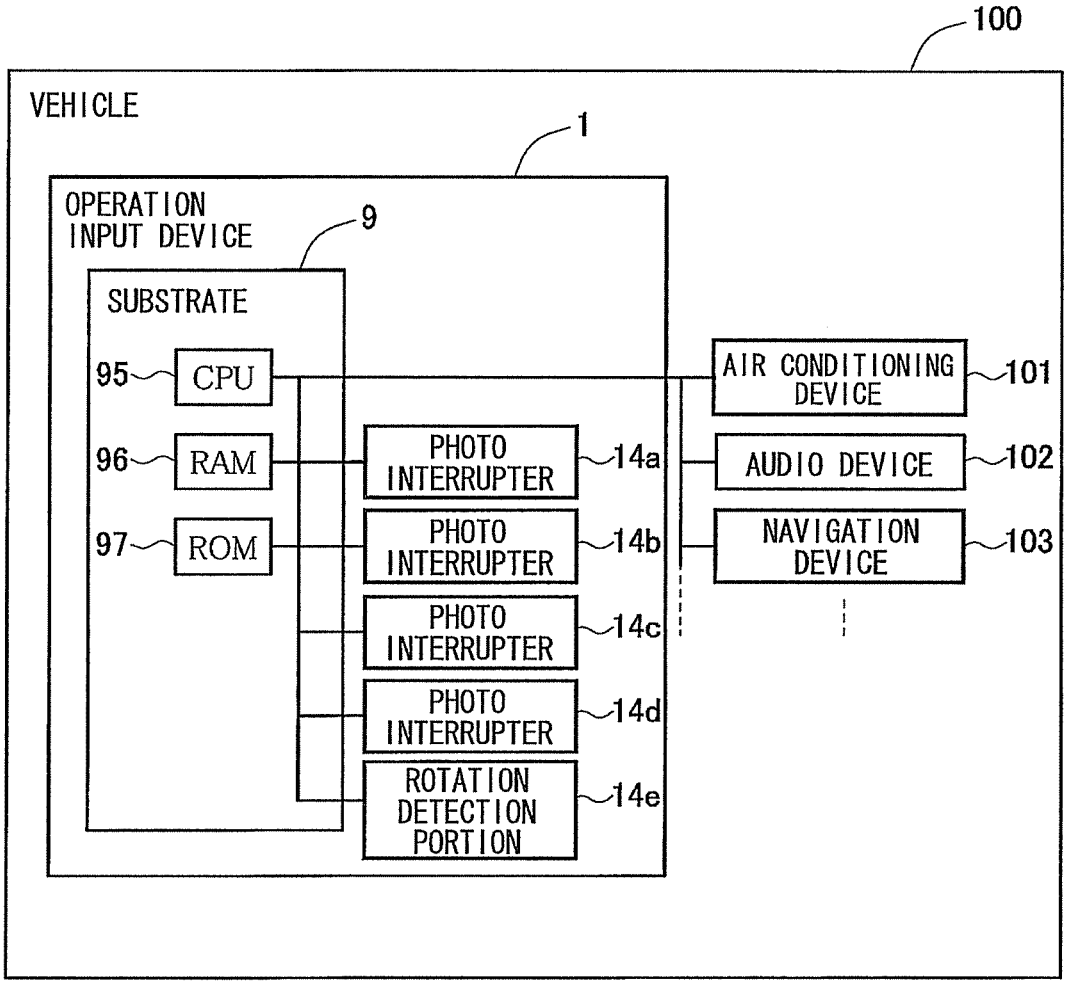
FIG. 29 is a view showing an installment example of the operation input device in a vehicle interior.

FIG. 26 is a perspective view of the device 1 from which the case 12 and the upper housing 13 are removed. FIG. 27 is a plan view of the device 1 from which the knob 2, the rotation shaft 3, and the swing shaft 5 are further removed. FIG. 28 is a view depicting a calculation routine of a detection result. FIG. 29 is a view showing a configuration in a case where the operation input device 1 is installed to an automobile.

As is shown in FIG. 29, the device 1 is electrically connected to an air conditioning device 101, an audio device 102, a navigation device 102 and the like of a vehicle 100, and, functions as a device that accepts operation inputs to various in-vehicle devices as specified above from a passenger of the vehicle 100.

As are shown in FIG. 26 and FIG. 27, four photo interrupters 14*a*, 14*b*, 14*c*, and 14*d* are disposed below four flange portions 56 of the swing shaft 5. In each of the photo interrupters 14*a*, 14*b*, 14*c*, and 14*d*, a light emitter portion 140 that outputs light from an LED or the like and a light receiver portion 141 that is provided with a light receiving element and receives light emitted from the light emitter portion 140 are disposed at opposing positions.

Each flange portion 56 has a hollow interior. Hence, for example, when the user performs a shaft pushing operation, the flange portions 56 move downward in a parallel direction and the four photo interrupters 14*a*, 14*b*, 14*c*, and 14*d* are inserted into the respective four flange portions 56. A shielding wall 56*a* is formed in a hollow region inside each flange portion 56. Hence, when the photo interrupters 14*a*, 14*b*, 14*c*, and 14*d* are inserted into the respective flange portions 56, each shielding wall 56*a* is interposed between the light emitter portion 140 and the light receiver portion 141 and blocks light transmitted from the light emitter portion 140 to the light receiver portion 141.

In a state where the photo interrupters 14*a*, 14*b*, 14*c*, and 14*d* are present on the outside of the flange portions 56, light emitted from the light emitter portion 140 is received at the light receiver portion 141. Upon receipt of light at the light receiver portion 141, the photo interrupters 14*a*, 14*b*, 14*c*, and 14*d* each output an OFF signal. When no light is received at the light receiver portion 141, the photo interrupters 14*a*, 14*b*, 14*c*, and 14*c*1 each output an ON signal.

As has been described above, the device 1 accepts a tilting operation in the eight directions D1 through D8 specified in FIG. 27, a shaft pushing operation, and a turning operation from the user. The four flange portions 56 of the swing shaft 5 and the four photo interrupters 14*a*, 14*b*, 14*c*, and 14*d* are disposed in the directions D1, D3, D5, and D7, respectively.

The four flange portions 56 are pushed downward by a shaft pushing operation or a tilting operation by the user and at least one (or all) of the photo interrupters 14*a*, 14*b*, 14*c*, and 14*d* is switched ON. Combinations of an ON state and an OFF state of the photo interrupters 14*a*, 14*b*, 14*c*, and 14*d* vary depending on which one of the shaft pushing operation and the tilting operations in the eight directions is performed.

FIG. 28 shows a manner in which the combinations vary. More specifically, when the user performs a shaft pushing operation, the four flange portions 56 move downward in a parallel direction and all of the photo interrupters 14*a*, 14*b*, 14*c*, and 14*d* are switched ON. When the user performs a tilting operation in the direction D1, the flange portion 56 in the direction D1 alone is pushed downward and the flange portions 56 in the other directions are not pushed downward. Hence, in the case of the tilting operation in the direction D1, the photo interrupter 14*a* alone is switched ON and the other photo interrupters 14*b*, 14*c*, and 14*d* remain in an OFF state.

When the user performs a tilting operation in the direction D3, the flange portion 56 in the direction D3 alone is pushed downward and the flange portions 56 in the other directions are not pushed downward. Hence, in the case of the tilting operation in the direction D3, the photo interrupter 14*b* alone is switched ON and the other photo interrupters 14*a*, 14*c*, and 14*d* remain in an OFF state.

When the user performs a tilting operation in the direction D5, the flange portion 56 in the direction D5 alone is pushed downward and the flange portions 56 in the other directions are not pushed downward. Hence, in the case of the tilting operation in the direction D5, the photo interrupter 14*c* alone is switched ON and the other photo interrupters 14*a*, 14*b*, and 14*d* remain in an OFF state.

When the user performs a tilting operation in the direction D7, the flange portion 56 in the direction D7 alone is pushed downward and the flange portions 56 in the other directions are not pushed downward. Hence, in the case of the tilting operation in the direction D7, the photo interrupter 14*c* alone is switched ON and the other photo interrupters 14*a*, 14*b*, and 14*d* remain in an OFF state.

Also, the shapes and the positional relations of the photo interrupters 14*a*, 14*b*, 14*c*, and 14*d* and the flange portions 56 are set so that when the user tilts the knob 2 in the direction D2, D4, D6, or D8, the photo interrupters on both the left and right sides of the tilting direction are switched ON.

According to this configuration, when the user performs a tilting operation in the direction D2, the flange portions 56 in the directions D1 and D3 on the both sides are pushed downward and the flange portions 56 in the other directions are not pushed downward. The photo interrupters 14*a* and 14*b* are disposed in the directions D1 and D3, respectively. Hence, in the case of the tilting operation in the direction D2, the photo interrupters 14*a* and 14*b* are switched ON and the photo interrupters 14*c* and 14*d* remain in an OFF state.

Likewise, when the user performs a tilting operation in the direction D4, the flange portions 56 in the directions D3 and D5 on the both sides are pushed downward and the flange portions 56 in the other directions are not pushed downward. The photo interrupters 14*b* and 14*c* are disposed in the directions D3 and D5, respectively. Hence, in the case of the tilting operation in the direction D4, the photo interrupters 14*b* and 14*c* are switched ON and the photo interrupters 14*a* and 14*d* remain in an OFF state.

When the user performs a tilting operation in the direction D6, the flange portions 56 in the directions D5 and D7 on the both sides are pushed downward and the flange portions 56 in the other directions are not pushed downward. The photo interrupters 14*c* and 14*d* are disposed in the directions D5 and D7, respectively. Hence, in the case of the tilting operation in the direction D6, the photo interrupters 14*c* and 14*d* are switched ON and the photo interrupters 14*a* and 14*b* remain in an OFF state.

When the user performs a tilting operation in the direction D8, the flange portions 56 in the directions D5 and D7 on the both sides are pushed downward and the flange portions 56 in the other directions are not pushed downward. The photo interrupters 14*d* and 14*a* are disposed in the directions D5 and D7, respectively. Hence, in the case of the tilting operation in the direction D8, the photo interrupters 14*d* and 14*a* are switched ON and the photo interrupters 14*b* and 14*c* remain in an OFF state.

With the use of these features, the device 1 detects which one of the shaft pushing operation and the tilting operations in the eight directions D1 through D8 was performed on the basis of combinations of ON and OFF outputs from the photo interrupters 14*a*, 14*b*, 14*c*, and 14*d*.

More, specifically, as is set forth in FIG. 28, in a case where the photo interrupter 14*a* alone is ON and the photo interrupters 14*b*, 14*c*, and 14*d* are OFF, the device 1 detects that the tilting operation in the direction D1 was performed. In a case where the photo interrupters 14*a* and 14*b* are ON and the photo interrupters 14*c* and 14*d* are OFF, the device 1 detects that the tilting operation in the direction D2 was performed. In a case where the photo interrupter 14*b* alone is ON and the photo interrupters 14*a*, 14*c*, and 14*d* are OFF, the device 1 detects that the tilting operation in the direction D3 was performed.

In a case where the photo interrupters 14*b* and 14*c* are ON and the photo interrupters 14*a* and 14*d* are OFF, the device 1 detects that the tilting operation in the direction D4 was performed. In a case where the photo interrupter 14*c* alone is ON and the photo interrupters 14*a*, 14*b*, and 14*d* are OFF, the device 1 detects that the tilting operation in the direction D5 was performed. In a case where the photo interrupters 14*c* and 14*d* are ON and the photo interrupters 14*a* and 14*b* are OFF, the device 1 detects that the tilting operation in the direction D6 was performed.

In a case where the photo interrupter 14*d* alone is ON and the photo interrupters 14*a*, 14*b*, and 14*c* are OFF, the device 1 detects that the tilting operation in the direction D7 was performed. In a case where the photo interrupters 14*d* and 14*a* are ON and the photo interrupters 14*b* and 14*c* are OFF, the device 1 detects that the tilting operation in the direction D8 was performed. In a case where all of the photo interrupters 14*a*, 14*b*, 14*c*, and 14*d* are ON, the device detects that the shaft pushing operation was performed.

As is shown in FIG. 29, the operation input device 1 (device) is installed, for example, to the vehicle (automobile) 100. A CPU 95, a RAM 96, and a ROM 97 are provided to the substrate 9 of the device 1. The CPU 95 performs information processing, such as various computations, relating to the device 1, and particularly detects an operation (which operation was performed) by the user on the device 1.

The RAM 96 is a volatile storage portion for a work area of the CPU 95. The ROM 97 is a non-volatile storage portion in which to store various types of data and programs used for the processing by the CPU 95. As is shown in FIG. 29, the substrate 9 is electrically connected to the photo interrupters 14*a*, 14*b*, 14*c*, and 14*d* and ON and OFF outputs from the photo interrupters 14*a*, 14*b*, 14*c*, and 14*d* are obtained by the substrate 9. The determination routine set forth in FIG. 28 is pre-stored in the ROM 97 in the form of a program. Hence, the CPU 95 determines a tilting direction and a shaft pushing operation by running this program.

The device 1 further includes a rotation detection portion 14*e* and detects a rotation operation by the user. As is shown in FIG. 26, the rotation detection portion 14*e* is of a bar shape protruding upward from a horizontal surface of the holder 8. A gear (toothed wheel) is formed on a radially outward end face of the flange portion 34 of the rotation shaft 3. Also, a gear is formed on a side surface of the rotation detection portion 14*e*. The both gears are meshed with each other.

When the knob 2 and the rotation shaft 3 are turned by a turning operation by the user, the turning motion is transmitted to the rotation detection portion 14*e* by these gears. The rotation detection portion 14*e* is furnished with a function of detecting a rotating angle. The rotating angle detected by the rotation detection portion 14*e* is transmitted to the substrate 9 and the rotation angle inputted by the user is recognized by the CPU 95.

Information on the inputs by the user (which one of the shaft pushing operation, the tilting operations in the eight directions, and the turning operation was performed and a rotation angle by the turning operation) recognized by the CPU 95 as described above is sent to the air conditioning device 101, the audio device 102, and the navigation device 103 installed to the vehicle 100 and these devices are controlled according to the inputs.

In the determination routine set forth in FIG. 28, a condition for the determinations in the directions D2, D4, D6, and D8 is that two photo interrupters be switched ON. However, there may be a case where two photo interrupters are not switched ON simultaneously when the user fails to perform an operation successfully. The device 1 can solve a problem in this case by means of software using the program of the determination routine. More specifically, for example, the device 1 does not make a determination for a predetermined, time (for example, several tens to 100 msec) since one photo interrupter is switched ON and when another photo interrupter is switched ON within the predetermined time, then the device 1 assumes that these photo interrupters are switched ON simultaneously.

Also, according to FIG. 28, in a case where the four photo interrupters are ON, the device 1 determines that a shaft pushing operation was performed. However, there may be a case where the user fails to switch ON the four photo interrupters successfully. Hence, it may be configured in such a manner that the device 1 determines that a shaft pushing operation was performed in a case where at least three photo interrupters are ON by the program of the determination routine.

As has been described, the device 1 of the present disclosure detects eight tilting directions (and a shaft pushing operation) using four photo interrupters. Assume that the photo interrupters are changed to contact-type switches. Then, elasticity of the contact-type switches provides the user with an operational feeling. Accordingly, the user has different operational feelings between directions (D1, D3, D5, and D7) in which switches are provided and directions (D2, D4, D6, and D8) in which switches are not provided. This configuration is therefore not preferable. In addition, in order to provide the user with the same operational feeling in all the eight directions using the contact-type switches, eight switches are required.

In contrast, according to the device 1 of the present disclosure, the photo interrupters are non-contact type detection means and the function of providing the user with an operational feeling is intensively furnished to the click plate 10. The device 1 therefore achieves significant advantages that it becomes possible to provide the user with the same operational feeling in all the eight directions, and moreover, it becomes possible to detect the eight tilting directions and a shaft pushing operation using four (less than eight) photo interrupters.

It goes without saying that the detection means in the embodiment above can be changed from photo interrupters to switches or sensors. There can be achieved advantages that it becomes possible to detect eight tilting directions and a shaft pushing operation by fewer (four) detection means in this case, too. The embodiment above has described tilting operations in eight directions. It should be appreciated, however, that the number of tilting directions is not limited to eight in the present disclosure. The tilting directions can be set to an even number, such as 10, 6, 4, and 2 or an odd number, such as 3, 5, and 7. The photo interrupters can be disposed at positions and in the number matching the number of the tilting directions. Also, the guide grooves of the click plate and the ribs 36 (first concavo-convex portions) of the rotation shaft 3 are changed to match the tilting directions. As many groove portions 132 (second concavo-convex portions) as a multiple of the number of the ribs 36 (first concavo-convex portions) can be formed in the upper housing 13.

Figure 30:
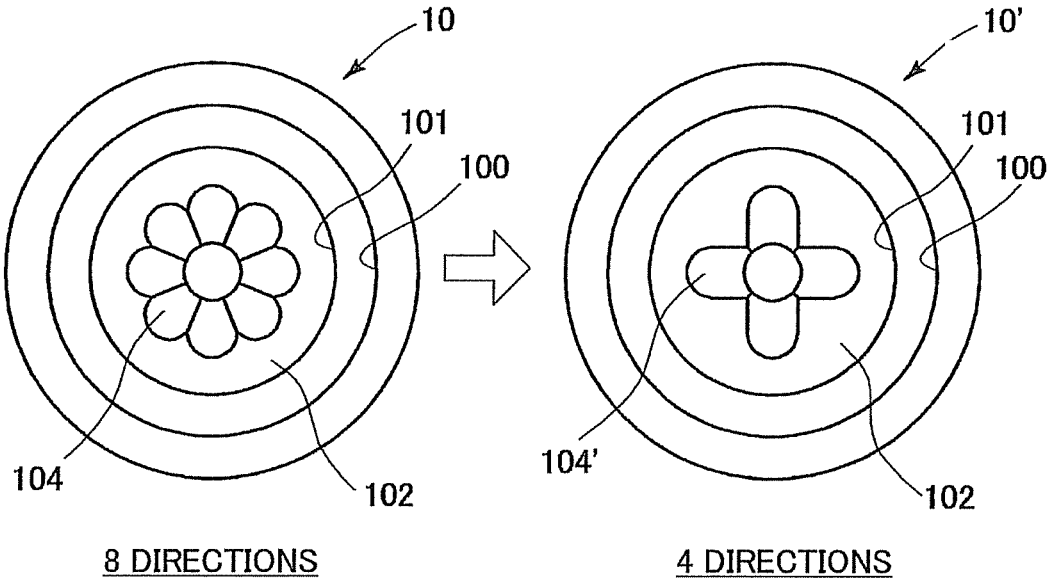
FIG. 30 is a view showing an example when the click plates are changed.

FIG. 30 shows a change from the click plate 10 to a click plate 10'. The click plate 10 is provided with the guide portion 104 that guides a tilting operation by the user to eight directions. The click plate 10' is provided with a guide portion 104' that guides a tilting operation by the user to four directions. The four directions by the guide portion 104' are four directions adjacent ones of which are orthogonal to each other. As in the guide portion 104, a ring-like convex portion and linear convex portions are formed therein.

As has been described, in the device 1, the function of guiding the oscillation plunger 40 in a tilting direction is intensively furnished to the click plate 10. The click plate 10 is pinched between the cover 11 and the substrate 9. Existing fixing methods, such as screwing and press-fitting, can be used arbitrarily as a fixing method of the click plate 10 to the substrate 9 and the cover 11. Hence, it is easy to change the click plate 10 (for example, to the click plate 10') in the device 1. Consequently, the number of tilting directions can be changed easily in the device 1.

In a case where the click plate 10 is changed to the click plate 10', the tilting operation is guided to the direction D1, D3, D5, or D7 described above. Whereas tilting motion in the direction D2, D4, D6, or D8 becomes quite difficult because of the shape of the guide portion 104'. Accordingly, even when the determination program for eight directions set forth in FIG. 28 is used in a case where the click plate 10' is used, the directions D2, D4, D6, and D8 are simply not detected, and there arises, no problem.

Hence, even when the click plate 10 is changed to the click plate 10', the determination program set forth in FIG. 28 can be used without any change. In other words, according to the device 1 of the present disclosure, once the determination program for eight tilting directions is installed therein, it becomes possible to change eight tilting directions to four tilting directions by merely changing the click plate 10 to the click plate 10'. For the same reason, for example, a change to two directions can be addressed by merely changing the click plates. It thus becomes possible to achieve an inexpensive derived product set with different operation directions from the device 1 of the present disclosure.

The present disclosure includes the following aspects.

According to an aspect of the present disclosure, an operation input device includes: an operation body having a handle portion, the handle portion being configured to beheld by a user and having a virtual operation aids line, the operation body being configured to tilt together with the handle portion around a predetermined rotation center point on the operation axis line in a case where the user holds the handle portion and tilts the operation axis line of the handle portion, and the operation body being capable of tilting in a predetermined number of tilting directions; a plurality of detection portions disposed at predetermined intervals in a circumferential direction of the operation axis line, the number of the plurality of detection portions being less than the predetermined number of tilting directions, each detection portion outputting a first output value in a case where the operation body tilts in a direction corresponding to the detection portion and outputting a second output value in a case where the operation body tilts in a direction not corresponding to the detection portion; and a determination device that determines a tilting direction of the operation body on the basis of information, on the number of first output values outputted from a part of the plurality of the detection portions and information on the part of the detection portions that have outputted the first output values.

The operation input device above is an operation input device configured to accept a tiling operation in predetermined multiple directions. The detection portions that output two values (for example, ON and OFF values) are disposed at positions fewer than the predetermined number of tilting directions. A tilting direction and a shaft pushing direction are determined not only on the basis of information as to whether the individual detection portions are ON or OFF but also on the basis of information as to whether one or more than one detection portion are outputting an ON value. Hence, by effectively using information as to whether one or more than one detection portion is outputting an ON value, it becomes possible to detect a tilting direction in a reliable manner even when there are fewer detection portions than the predetermined number of tilting direction. It thus becomes possible to achieve an operation input device capable of detecting a tilting direction in a reliable manner while achieving an object to reduce the number of detection portions.

Alternatively, the plurality of detection portions may include a first detection portion (14*a* thought 14*d*) and a second detection portion. The determination device does not determine the tilting direction for a predetermined period in a case where the first detection portion outputs the first output value. The determination device determines that the first detection portion and the second detection portion output the first output values simultaneously in a case where the second detection portion outputs the first output value within the predetermined period. In this case, according to the invention, in a case where another detection portion is switched ON within the predetermined time after one detection portion was switched ON, it is assumed that the two detection portions are switched ON simultaneously. Owing to this configuration, although there is a case where a tilting direction wobbles when the user fails to tilt the operation body successfully in a desired tilting direction depending on a manner in which the user applies a force on the operation body during a tilting operation, it becomes possible to detect a tilting direction in a reliable manner even in such a case.

Alternatively, in a case where the user holds the handle portion and presses the handle portion in a direction of the operation axis line, the operation body may move parallel together with the handle portion along the direction of the operation axis line. The determination device includes a first sub-determination device. The first sub-determination device determines that the operation body is pushed in the direction of the operation axis line in a case where all of the detection portions output the first output values. In this case, the operation input device configured to accept not only a tilting operation in multiple directions but also a shaft pushing operation determines a shaft pushing operation in a case where all of the detection portions are ON. It thus becomes possible to detect a shaft pushing operation as well without having to increase the number of the detection portions used to detect a tilting direction.

Alternatively, the determination device may further include a second sub-determination device. The second sub-determination device determines that the operation body has tilted in one of the tilting directions in a case where the number of the detection portions that have outputted the first output values is less than a predetermined number. In this case, the determination portion determines a shaft pushing operation when all of the detection portions are ON, and a tilting operation when the number of the detection portions that are ON is less than a predetermined number. Hence, by effectively using information on the number of the detection portions that are ON, it becomes possible to achieve an operation input device capable of determining both of a shaft pushing operation and a tilting operation while achieving an object to reduce the number of the detection portions.

Alternatively, the predetermined number of the tilting directions may be eight. The tilting direction of the operation body is one of eight directions, which are obtained by dividing a circumferential direction of the operation axis line by eight. The number of the detection portions is four. In this case, only four detection portions are provided for eight directions as the predetermined number of tilting directions. It thus becomes possible to achieve an operation input device capable of determining eight tilting directions using fewer detection portions.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. An operation input device comprising:

an operation body having a handle portion, the handle portion being configured to be held by a user and having an operation axis line in virtual, the operation body being configured to tilt to any of eight tilting directions, which are obtained by dividing a circumferential direction of the operation axis line by eight, together with the handle portion around a predetermined rotation center point on the operation axis line in a case where the user holds the handle portion and tilts the operation axis line of the handle portion, and move parallel along a direction of the operation axis line together with the handle portion in a case where the user holds the handle portion and presses the handle portion in the direction of the operation axis line;

four detection portions disposed at predetermined intervals in the circumferential direction of the operation axis line, wherein each of the four detection portions contactlessly detects a state where the operation body tilts in a direction corresponding to the each of the four detection portions and outputs a first output value, and each of the four detection portions contactlessly detects another state where the operation body tilts in a direction not corresponding to the each of the four detection portion and outputs a second output value;

an abutting portion having a surface on which a tip end of the operation body along the direction of the operation axis line abuts in a case where the operation axis line of the handle portion is tilted or the handle portion is pressed, and providing the user with a same operational feeling in all the eight tilting directions in a case where the operation axis line of the handle portion is tilted; and a determination device that determines one of the eight tilting directions of the operation body or determines whether the handle portion has been pressed, based on information on a total number of first output values outputted from a part of the four detection portions and information on the part of the four detection portions that have outputted the first output values, wherein the determination device includes a first sub-determination device, a second sub-determination device, and a third sub-determination device, wherein the first sub-determination device determines that the operation body has been pressed in the direction of the operation axis line in a case where the four detection portions output the first output values, wherein the second sub-determination device determines that the operation axis line of the handle portion has been tilted in one of the eight tilting directions in a case where a total number of the four detection portions that have outputted the first output values is less than a predetermined number, and wherein the third sub-determination device does not determine a tilting direction for a predetermined period in a case where one of the four detection portions outputs the first output value, and determines that the one of the four detection portions and another of the four detection portions output the first output values simultaneously in a case where the another of the four detection portions outputs the first output value within the predetermined period.

2. The operation input device according to claim 1, wherein the detection portion includes a light emitter portion that outputs light, and a light receiver portion that receives the light emitted from the light emitter portion, wherein, in a case where the operation body tilts in a direction corresponding to the one of the four detection portions, the light emitted from the light emitter portion is interrupted before the light receiver portion receives the light, and the one of the four detection portions outputs the first output value, and wherein the detection portion is a photo interrupter.

3. The operation input device according to claim 2, wherein the abutting portion is a click plate, wherein the abutting portion includes a guide portion guiding the tip end of the operation body when the operation axis line of the handle portion is tilted to each of the eight tilting directions, and wherein the guide portion has eight surfaces with a same shape in the eight tilting directions, the eight surfaces abutting the tip end.

4. The operation input device according to claim 2, wherein the tip end is an oscillation plunger pushed by an elastic member to a direction of the abutting portion.

5. The operation input device according to claim 1, wherein the abutting portion is a click plate, wherein the abutting portion includes a guide portion guiding the tip end of the operation body when the operation axis line of the handle portion is tilted to each of the eight tilting directions, and wherein the guide portion has eight surfaces with a same shape in the eight tilting directions, the each of the eight surfaces abutting the tip end.

6. The operation input device according to claim 5, wherein the tip end is an oscillation plunger pushed by an elastic member to a direction of the abutting portion.

7. The operation input device according to claim 1, wherein the tip end is an oscillation plunger pushed by an elastic member to a direction of the abutting portion.

* * * * *